US010973301B2

(12) United States Patent
Crapet

(10) Patent No.: US 10,973,301 B2
(45) Date of Patent: Apr. 13, 2021

(54) PACKAGING DEVICE FOR A COSMETIC PRODUCT

(71) Applicant: ALBEA SERVICES, Gennevilliers (FR)

(72) Inventor: Yann Crapet, Fremecourt (FR)

(73) Assignee: ALBEA SERVICES, Gennevilliers (FR)

( * ) Notice: Subject to any disclaimer, the term of this patent is extended or adjusted under 35 U.S.C. 154(b) by 9 days.

(21) Appl. No.: 16/321,446

(22) PCT Filed: Jul. 21, 2017

(86) PCT No.: PCT/EP2017/068554
§ 371 (c)(1),
(2) Date: Jan. 28, 2019

(87) PCT Pub. No.: WO2018/019739
PCT Pub. Date: Feb. 1, 2018

(65) Prior Publication Data

US 2019/0159574 A1 May 30, 2019

(30) Foreign Application Priority Data

Jul. 27, 2016 (FR) ..... 1657206

(51) Int. Cl.
*A45D 40/18* (2006.01)
*A45D 40/22* (2006.01)
*A45D 40/00* (2006.01)

(52) U.S. Cl.
CPC ..... *A45D 40/18* (2013.01); *A45D 40/00* (2013.01); *A45D 40/22* (2013.01); *A45D 40/221* (2013.01);
(Continued)

(58) Field of Classification Search
CPC ..... A45D 40/00; A45D 40/22; A45D 40/222; A45D 40/221; A45D 40/225; A45D 40/18;
(Continued)

(56) References Cited

U.S. PATENT DOCUMENTS 1,852,455 A * 4/1932 Friedman ..... A45D 33/00 132/293
5,437,294 A * 8/1995 Ebbets, III ..... A45D 40/22 132/296
(Continued)

FOREIGN PATENT DOCUMENTS

FR 3016116 7/2015

*Primary Examiner* — Rafael A Ortiz
(74) *Attorney, Agent, or Firm* — Steven M. Greenberg, Esq.; Shutts & Bowen LLP

(57) ABSTRACT

The invention concerns a packaging device (10) for a cosmetic product (P), especially for a solid or pasty cosmetic product, having a base (20), an intermediate part (30) intended to carry the product (P) and a lid (40), the intermediate part (30) being secured to the base (20) and the lid (40) being mounted hinged on the intermediate part (30) so that said lid (40) occupies two positions, a first position, called the closed position of the device where the base (20) and the lid (40) together define a substantially closed space, and a second position, called the opened position of the device where the lid (40) is retracted inside the base (20), wherein the lid (40) is configured to be blocked in an opened position—reciprocally in a closed position—by blocking means having at least one protrusion (39) of matter protruding from the intermediate part (30).

9 Claims, 13 Drawing Sheets

Figure 1A:
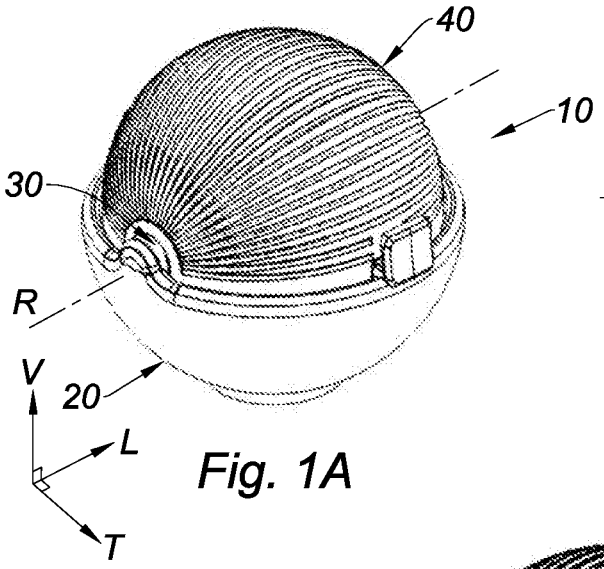

(52) U.S. Cl.
CPC .... *A45D 40/222* (2013.01); *A45D 2040/0006* (2013.01); *A45D 2040/225* (2013.01); *A45D 2040/226* (2013.01)

(58) Field of Classification Search
CPC ..... A45C 2040/226; A45C 2040/0006; A45C 2040/225
USPC ..... 206/385, 581
See application file for complete search history.

(56) References Cited

U.S. PATENT DOCUMENTS

| | | | | |
|---|---|---|---|---|
| 8,651,308 | B1 * | 2/2014 | Sung | A45D 40/00 220/4.25 |
| 2007/0292344 | A1 | 12/2007 | Turner | |
| 2008/0000493 | A1 * | 1/2008 | Anderson | A45D 33/006 132/295 |
| 2015/0037082 | A1 * | 2/2015 | Pires | A45D 40/00 401/88 |

* cited by examiner

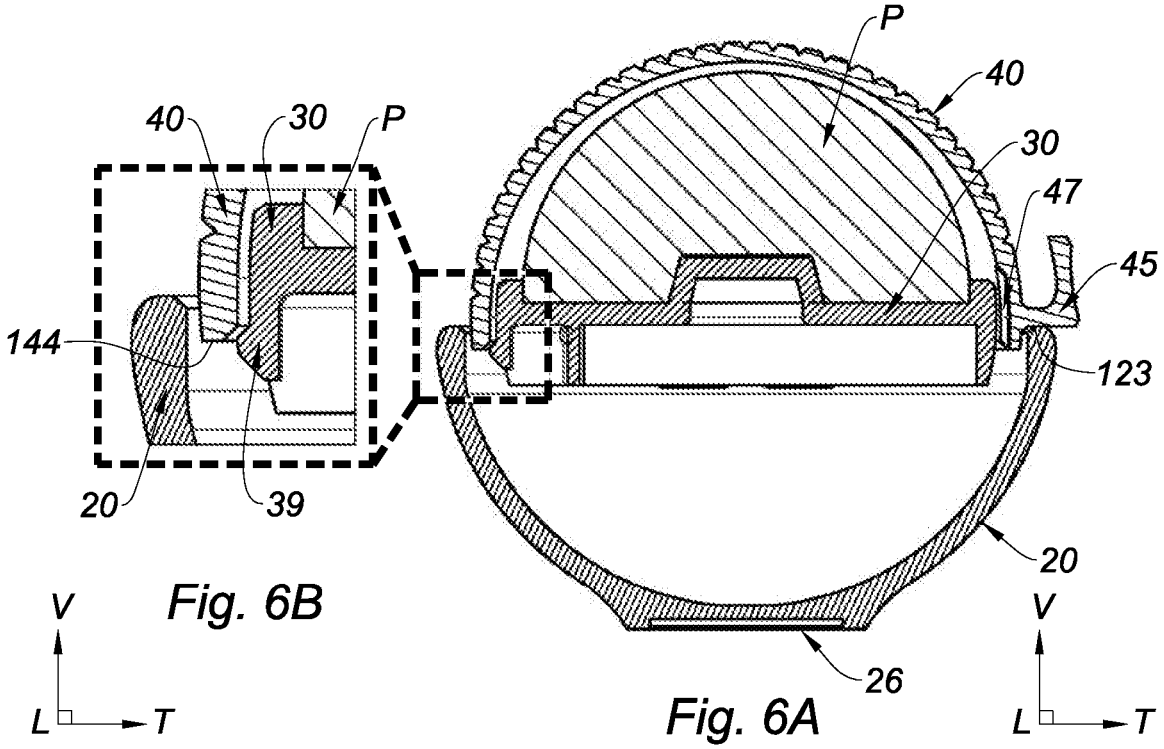
Fig. 6B
Fig. 6A
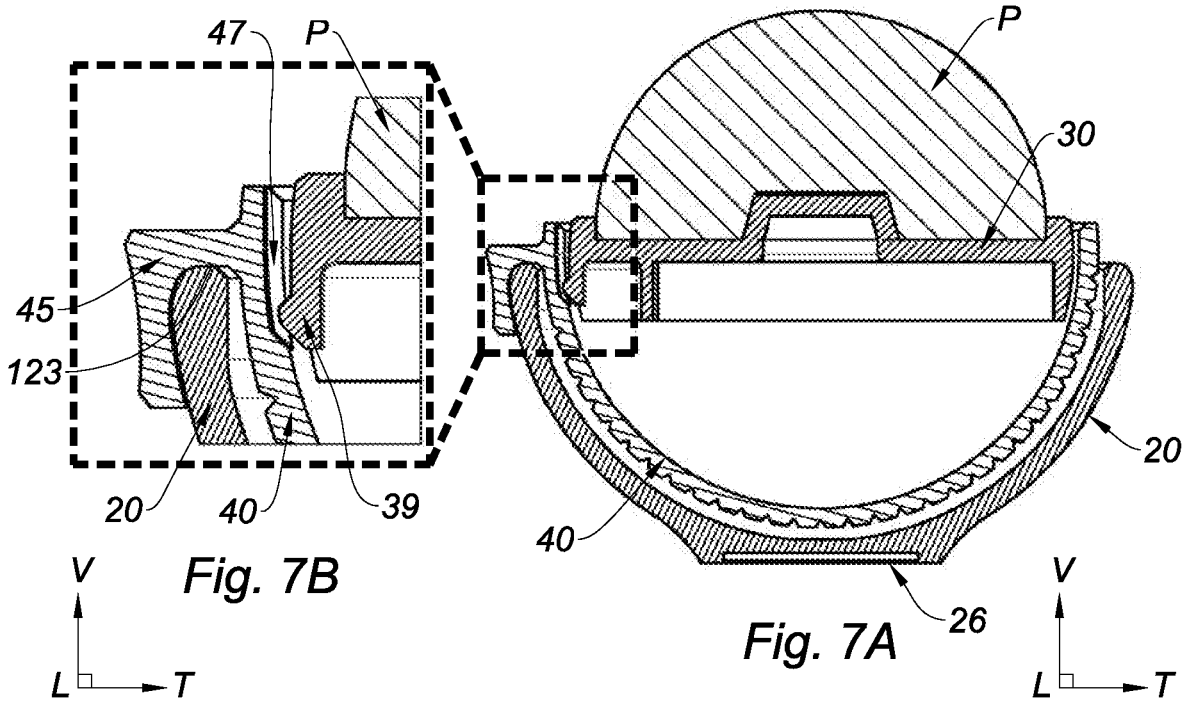
Fig. 7B
Fig. 7A

PACKAGING DEVICE FOR A COSMETIC PRODUCT

CROSS-REFERENCE TO RELATED APPLICATIONS

This application is a § 371 national phase entry of International Application No. PCT/EP2017/068554, filed Jul. 21, 2017, which claims priority to French Patent Application No. 1657206, filed Jul. 27, 2016.

The invention concerns a packaging device for a cosmetic product, especially for a cosmetic product in a solid or in a pasty form i.e. that does not disperse when outside of its packaging, such as lipstick, lip balm, blush, eye shadow and foundation.

The state of the art discloses devices for the packaging of lipstick especially, where the opening of the device is performed by pivoting a first part about an axis of rotation, this first part being fully nested in a second part to reveal the product when the device is in an opened position.

However, this type of device is often not adapted to limit the motion of the lid when the latter is pivoted inside the base and to ensure the blocking of the lid in an opened or closed position.

One of the purposes of the invention is therefore to propose a solution to control the pivoting movement of the lid during the opening of the packaging device and to ensure the blocking of the lid in both an opened and a closed position.

An advantage of this invention is to allow the consumer to use the device according to the invention without having to stop the motion and block the lid. In other words, when the device is in an opened position, the lid remains concealed in the base of the device, in a stable manner, without pivoting backwards. The consumer can therefore access the cosmetic product, without the nuisance of an uncontrolled return of the lid. Furthermore, its unwanted opening, for example in a handbag, is thereby avoided.

Therefore, the invention concerns a packaging device for cosmetic product, especially for solid or pasty cosmetic product, comprising a base, an intermediate part intended to carry the cosmetic product and a lid, the intermediate part being secured to the base and the lid being mounted hinged on the intermediate part so that said lid occupies two positions, a first position, called the closed position of the device, where the base and the lid together define a substantially closed space, and a second position, called the opened position of the device, where the lid is retracted inside the base, wherein said lid is configured to be blocked in an opened position—and reciprocally in a closed position—by blocking means comprising at least one protrusion of matter protruding from the intermediate part.

Advantageously, the packaging device for cosmetic product, especially for solid or pasty cosmetic product, comprises a base, an intermediate part and a lid, the intermediate part being mounted in the base and the lid being mounted hinged on the intermediate part so that the lid occupies two positions, a first position, called the closed position where the base and the lid together define a substantially closed space, and a second position, called the opened position where the lid is retracted inside the base, wherein:

- the base serves as a means to grab the device and to support the intermediate part,
- the lid is configured, on one hand, to be blocked in an opened position—reciprocally in a closed position—and on the other hand to pivot, by a rotational movement, inside the base,

- the intermediate part is intended to carry the cosmetic product and to make it accessible in an opened position of the device.

According to the invention, the packaging device further comprises blocking means enabling to maintain the lid in an opened position and reciprocally in a closed position, the blocking means being provided in the form of a protrusion of matter protruding from the intermediate part, the protrusion of matter being intended to abut against the lid, the transition from the closed position to the opened position and inversely being performed with a limited effort, applied to the lid, so as to unblock the lid from its position without having to resort to an external tool.

Advantageously, the invention enables to control the pivoting movement of the lid during the opening of the packaging device.

The invention enables to control the blocking of the lid, both in an opened and in a closed position.

According to Other Characteristics of the Invention:

- the intermediate part comprises a rim, said at least one protrusion of matter protruding from an outer face of the rim;
- said at least one protrusion of matter protruding from the intermediate part is in permanent abutment with an inner face of the lid during the progressive pivoting of the lid inside the base, from the closed position to the opened position;
- the lid comprises at least one notch intended to receive the protrusion of matter protruding from the intermediate part at the end of the motion of the lid to retain the lid in an opened position;
- when the lid occupies the closed position, the notch and the protrusion of matter are located opposite one another;
- said at least one protrusion of matter cooperates with an edge of the lid to block said lid in a closed position;
- the intermediate part comprises two concentric rims, respectively an outer rim and an inner rim, said at least one protrusion of matter protruding from the inner face of the outer rim;
- said at least one protrusion of matter is practically continuous circumferentially;
- the outer rim and the inner rim of the intermediate part are connected to one another by at least hinging means formed by two trunnions that define an axis of rotation for the lid;
- the outer rim and the inner rim of the intermediate part together delimit an opening configured to enable the passage of the lid;
- the outer rim of the intermediate part comprises at least a protrusion of matter intended to cooperate with at least a first lug of the lid to block said lid in an opened position;
- the outer rim of the intermediate part comprises at least an outgrowth of matter intended to cooperate with at least a second lug of the lid to block said lid in a closed position;
- the lid comprises a gripping means designed to enable the handling of the lid so as to move it from its opened position to its closed position and inversely, said gripping means forming a stop to immobilise the motion of the lid in a closed position as well as in an opened position;
- the first lug and the second lug of the lid are arranged on either side of the gripping means;
- the intermediate part comprises retaining means, intended to be engaged with the cosmetic product, which extend radially inside the intermediate part and delimiting together at least one opening to enable the casting of said cosmetic product.

According to other characteristics, taken together or separately:

- the intermediate part presents at least a rim, the said at least a rim presenting an outer face and an inner face,
- the protrusion of matter protrudes from the outer or inner face of the rim,
- the protrusion of matter protrudes from the outer face, at the rear of the rim,
- the lid presents an outer face and an inner face,
- the outer face of the lid presents a gripping means resting on the base, the gripping means being designed to enable the handling of the lid so as to move it from its opened position to its closed position, and inversely,
- the gripping means is located at the front on the outer face of the lid in a closed position of the device,
- the gripping means is able to serve as a stop to immobilise the motion of the lid in a closed position and in an opened position, especially by contact with an edge of the base or of the intermediate part,
- the protrusion of matter protruding from the intermediate part is in permanent abutment with the inner face of the lid during the progressive pivoting of the lid inside the base, from the closed position to the opened position;
- the inner face of the lid presents at least one notch intended to receive the protrusion of matter protruding from the intermediate part at the end of the motion of the lid so as to retain the lid in an opened position,
- the notch is located at the front on the inner face of the lid in a closed position,
- the notch and the protrusion of matter are located diametrically opposite one another, along the transversal axis, in a closed position of the device,
- the protrusion of matter is housed inside the notch, at the rear of the device, in an opened position of the device.

Figure 1C:
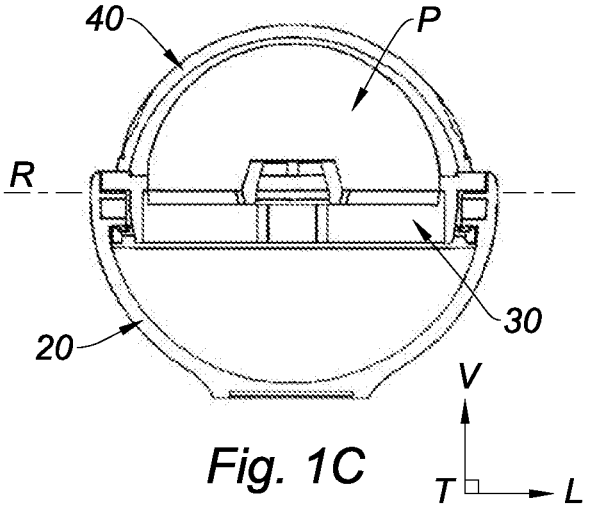
Figure 1B:
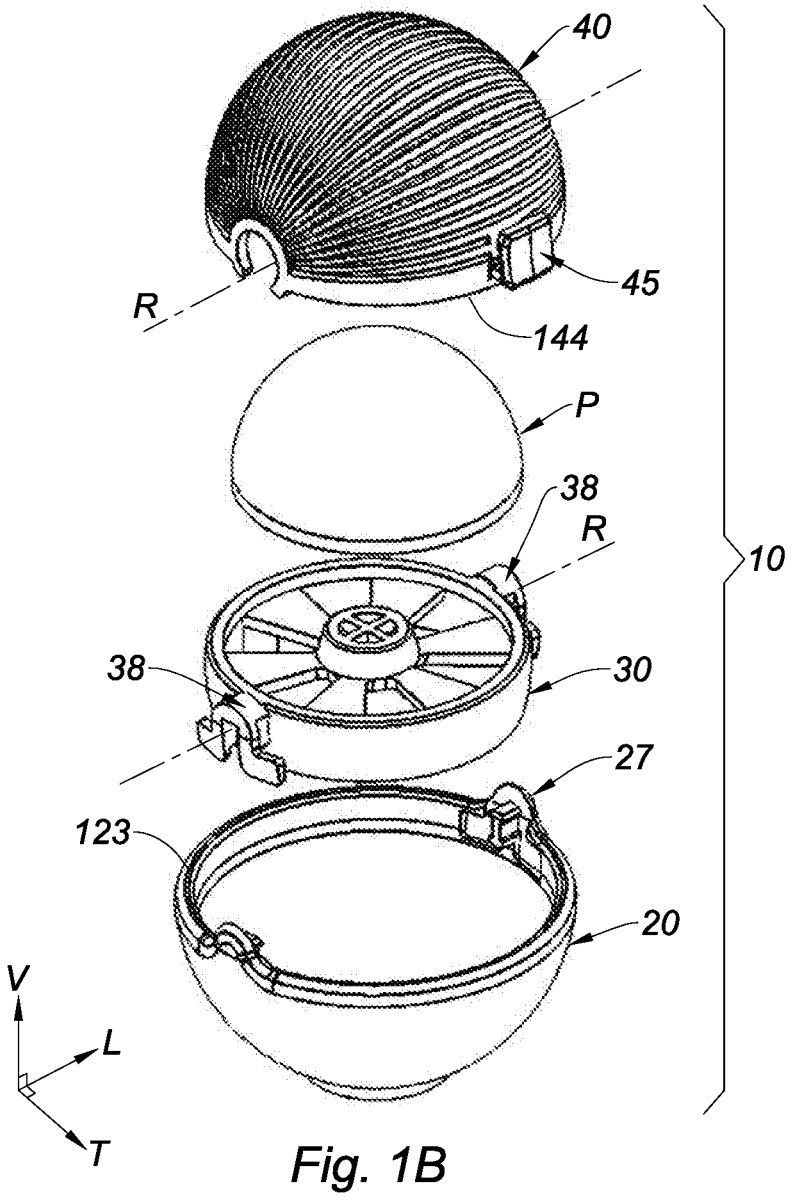
Figure 2A:
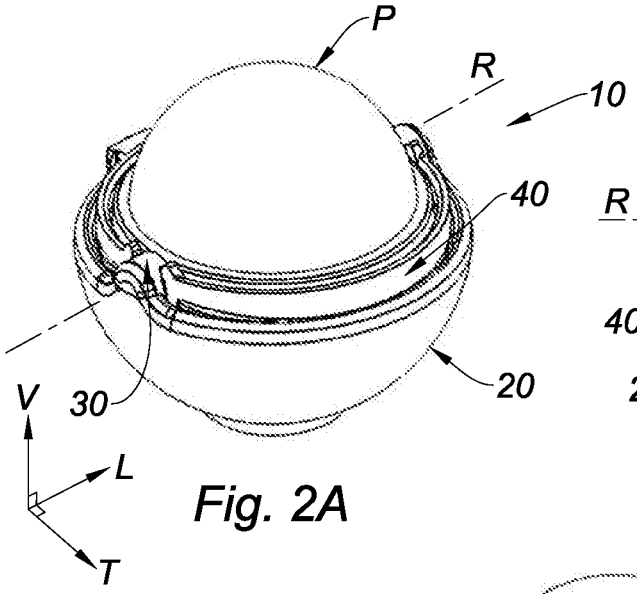
Figure 2C:
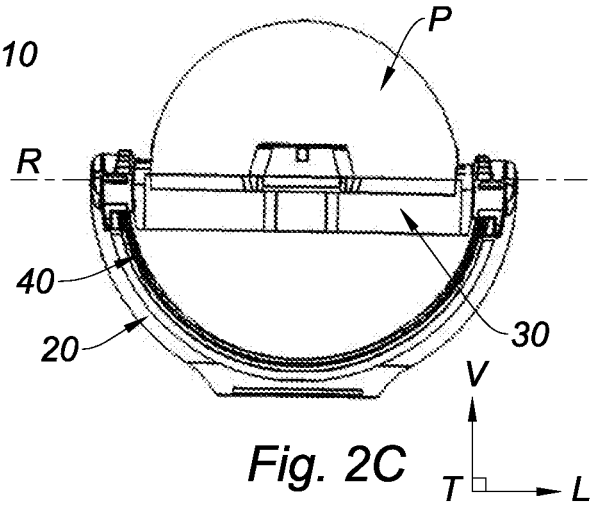
Figure 2B:
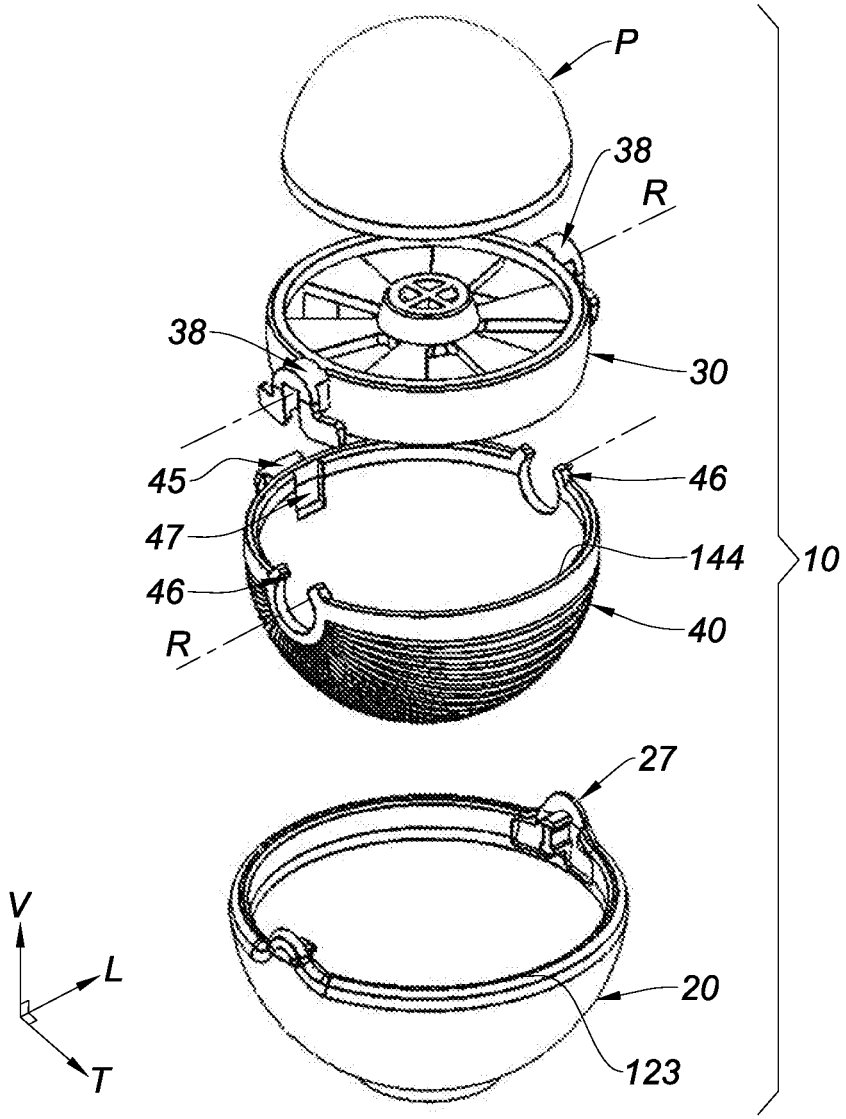
Figure 3A:
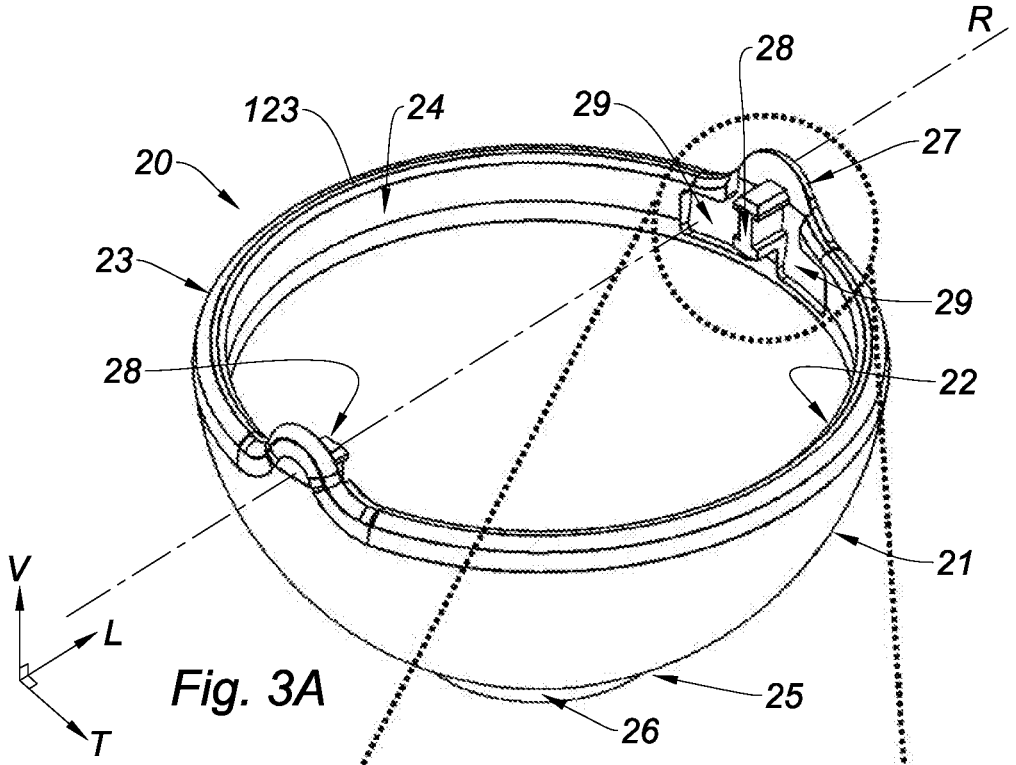
Figure 3B:
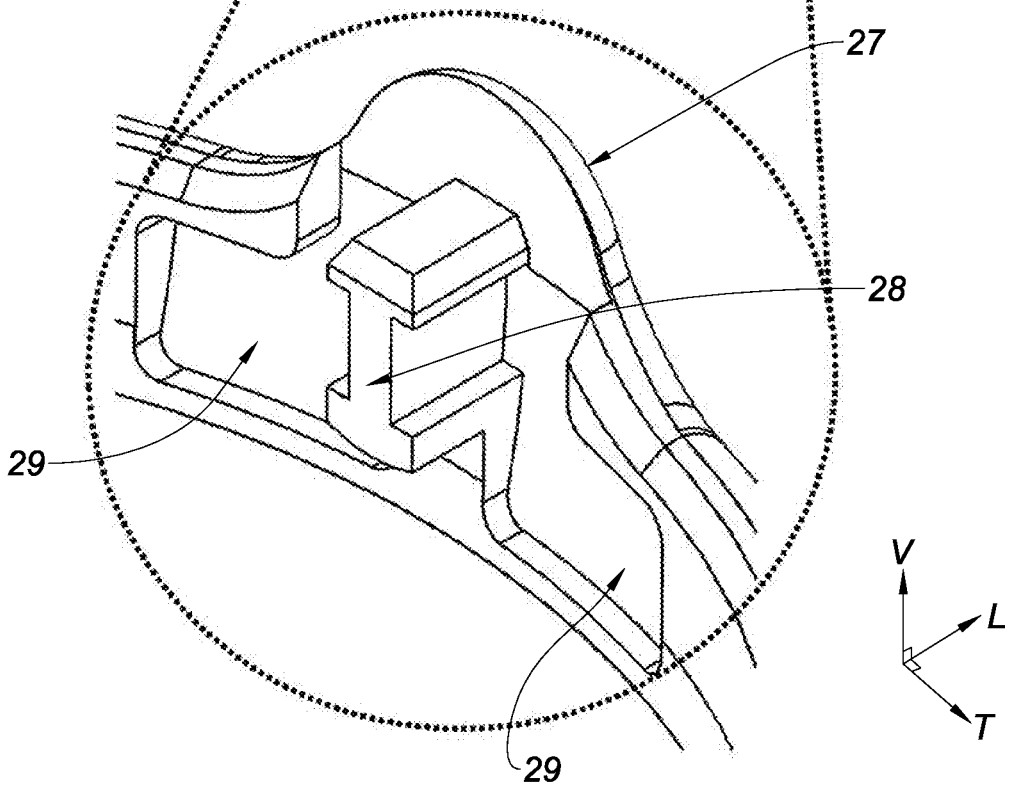
Figure 4A:
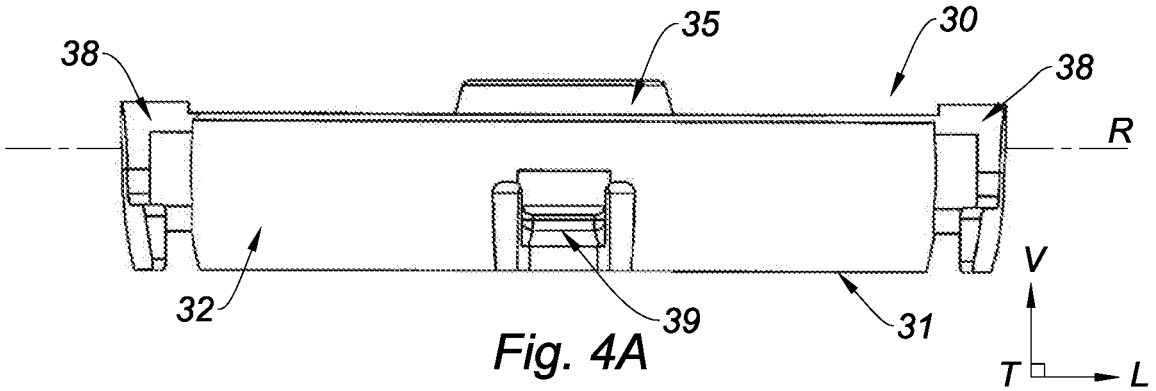
Figure 4B:
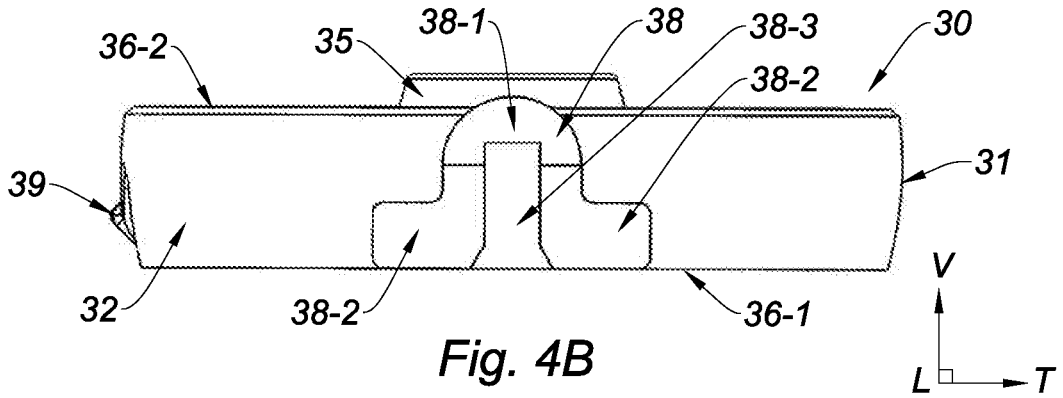
Figure 4C:
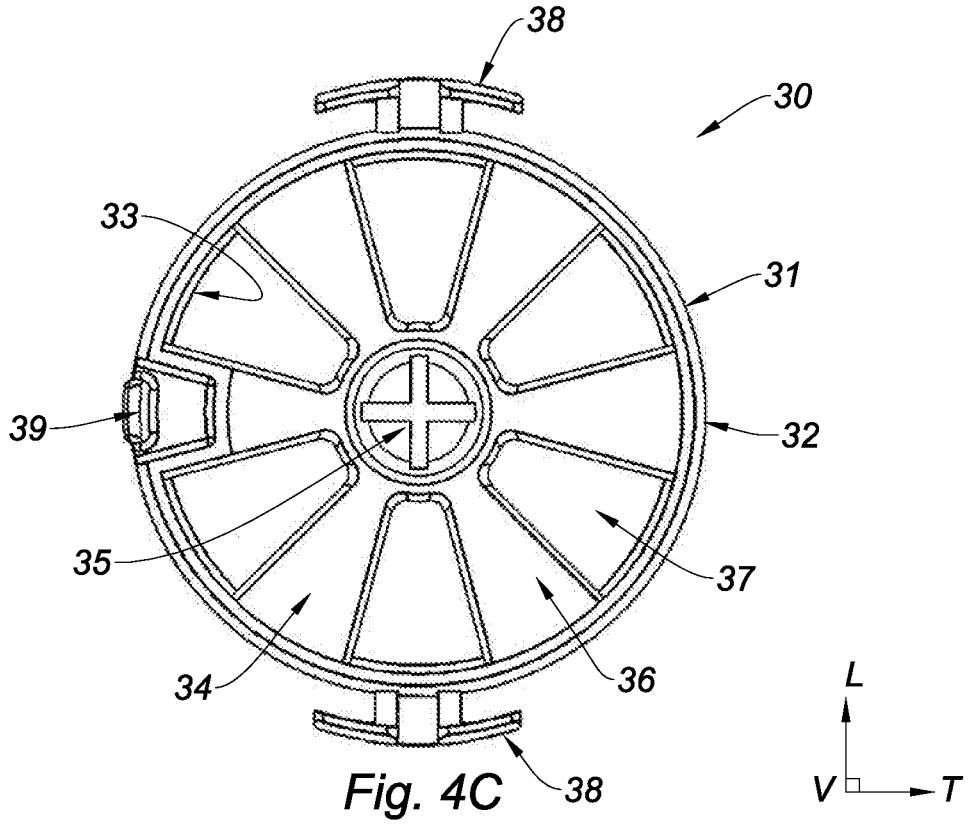
Figure 4D:
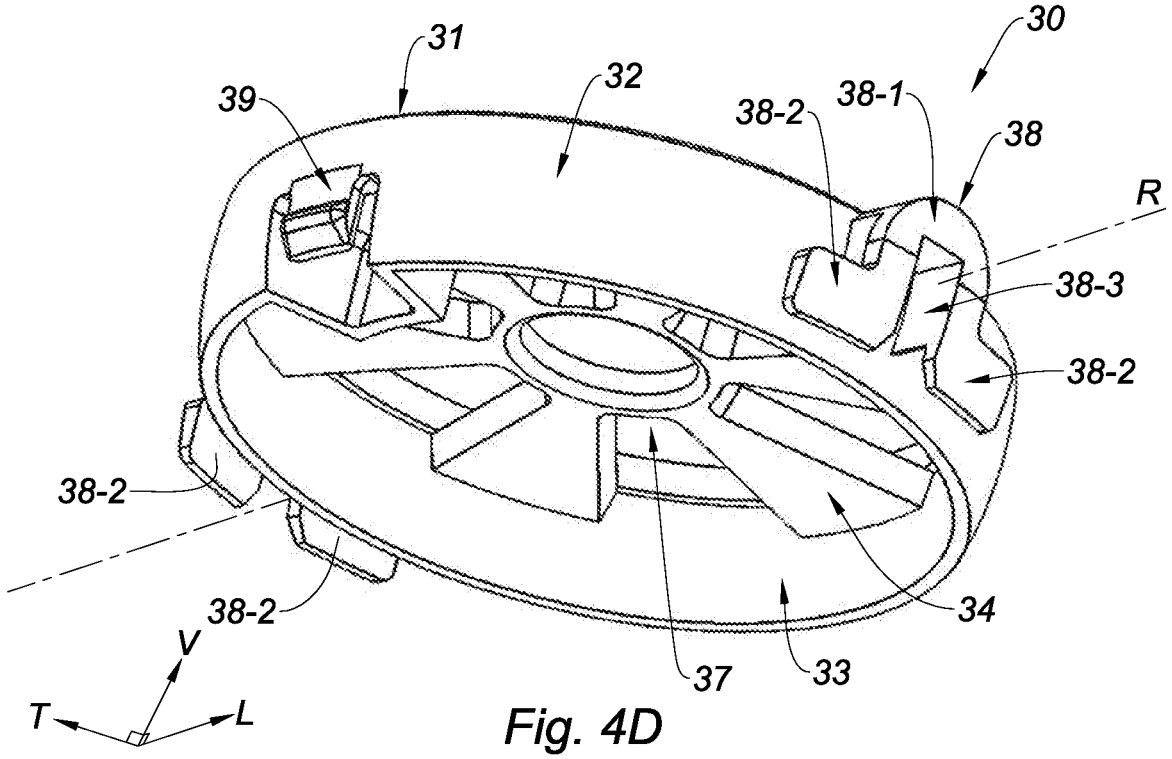
Figure 4E:
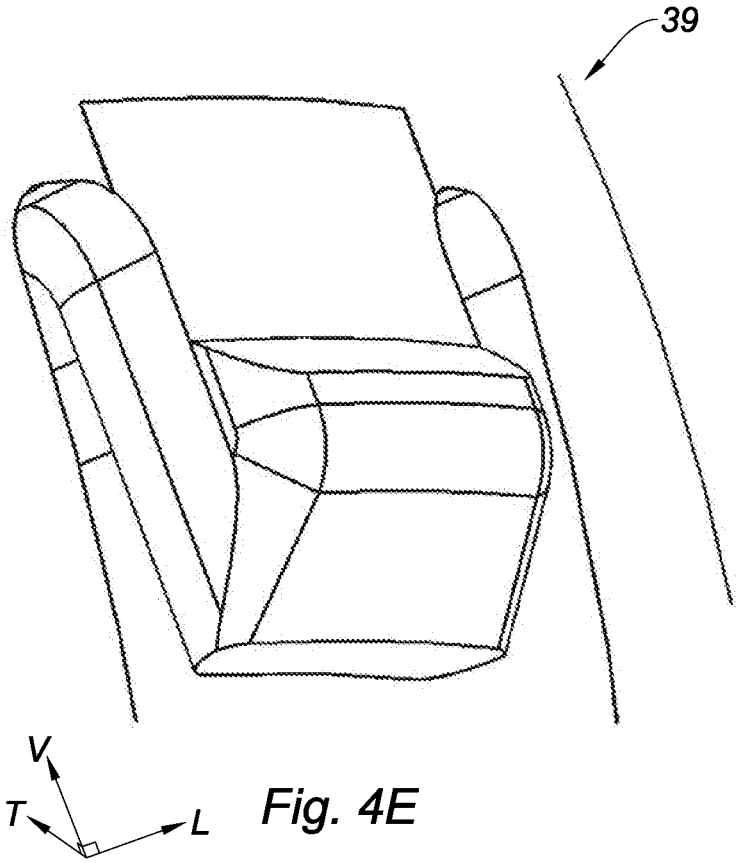
Figure 5A:
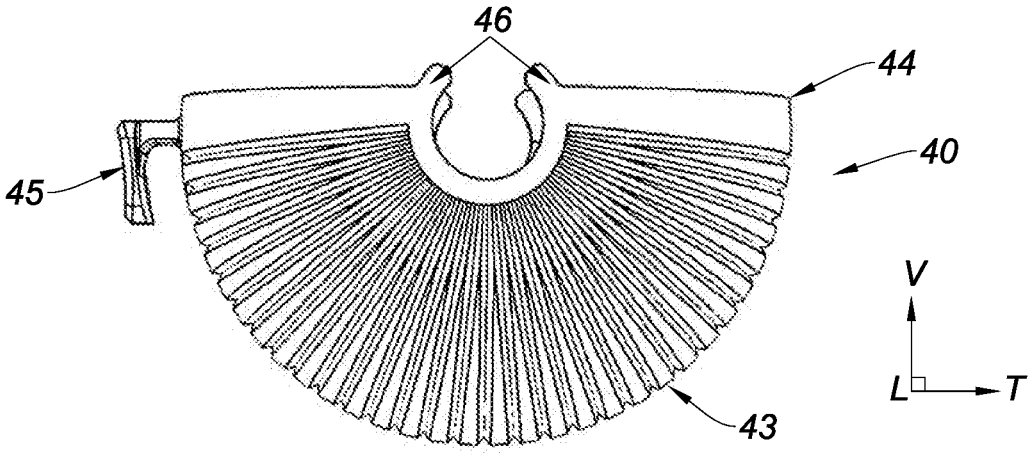
Figure 5B:
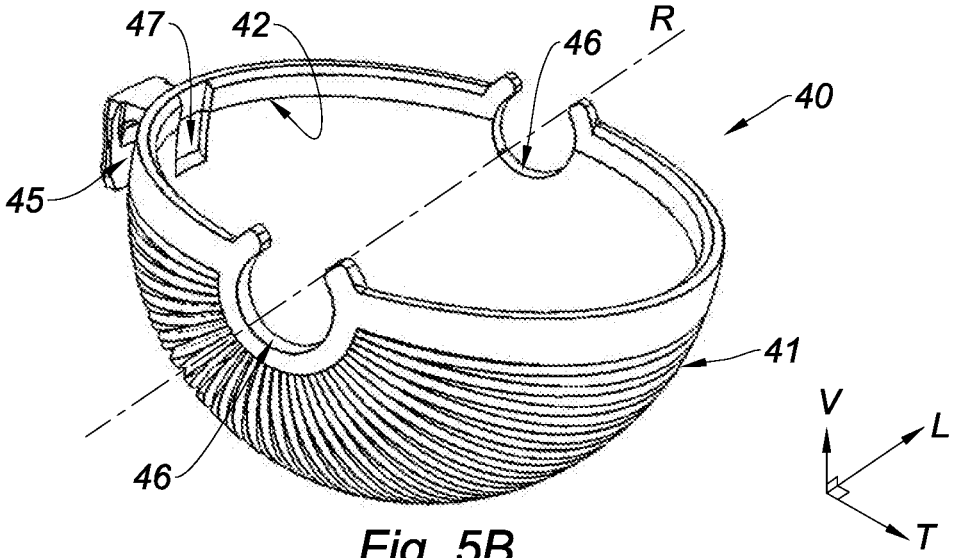
Figure 5C:
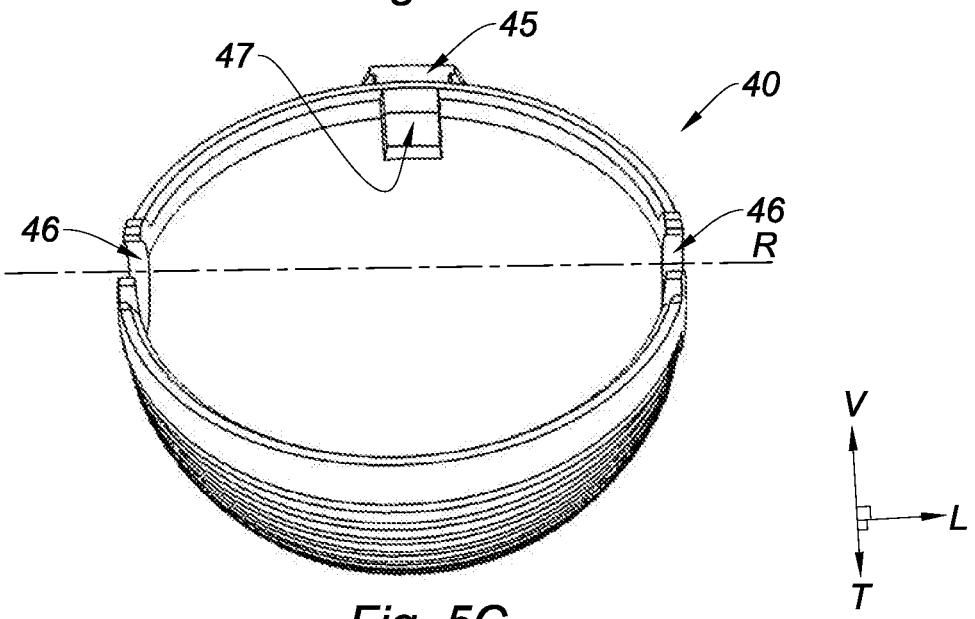
Figure 8:
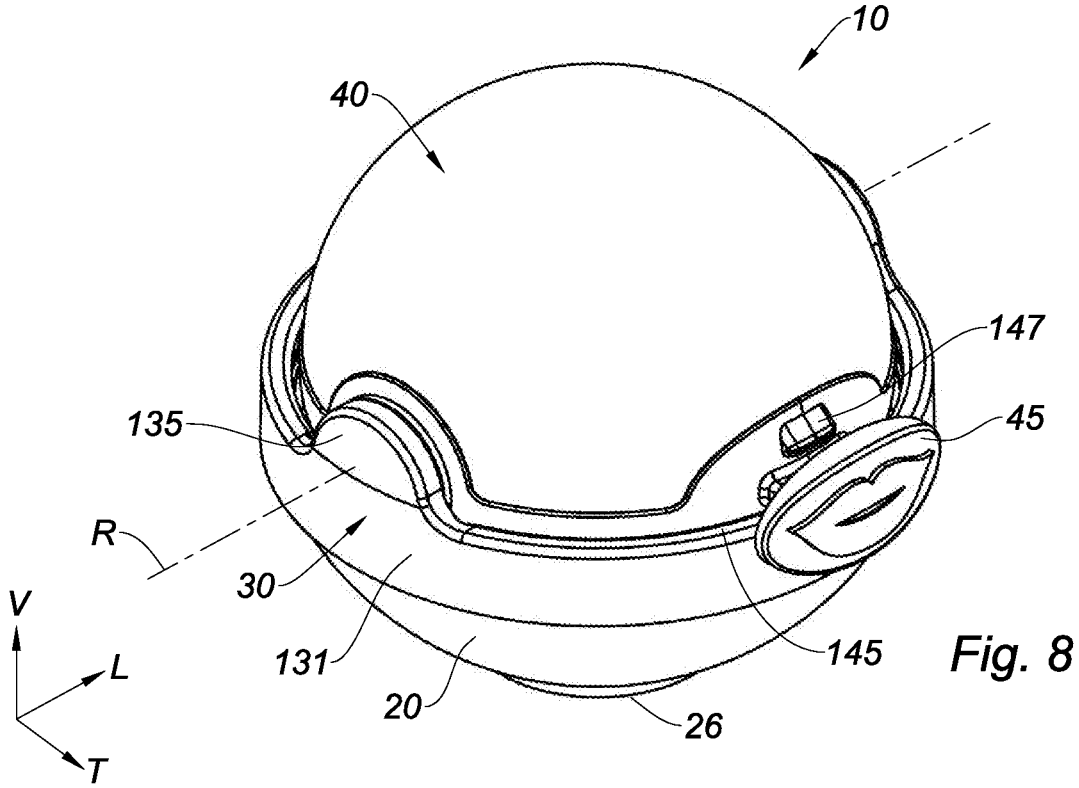
Figure 9:
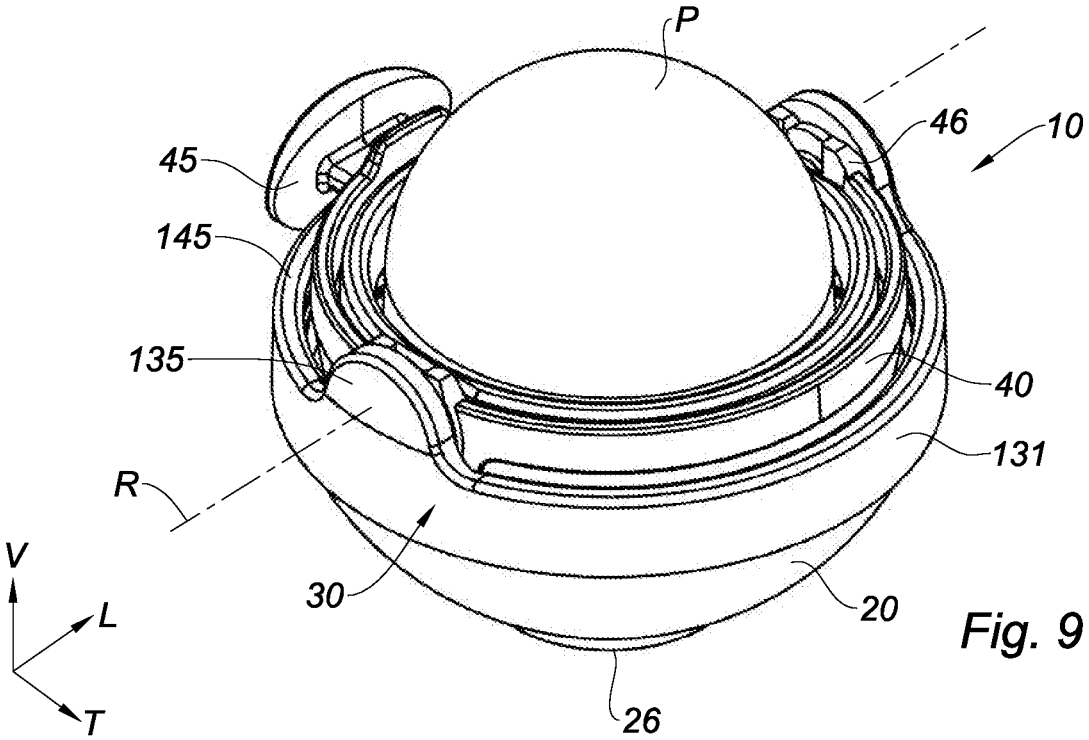
Figure 10:
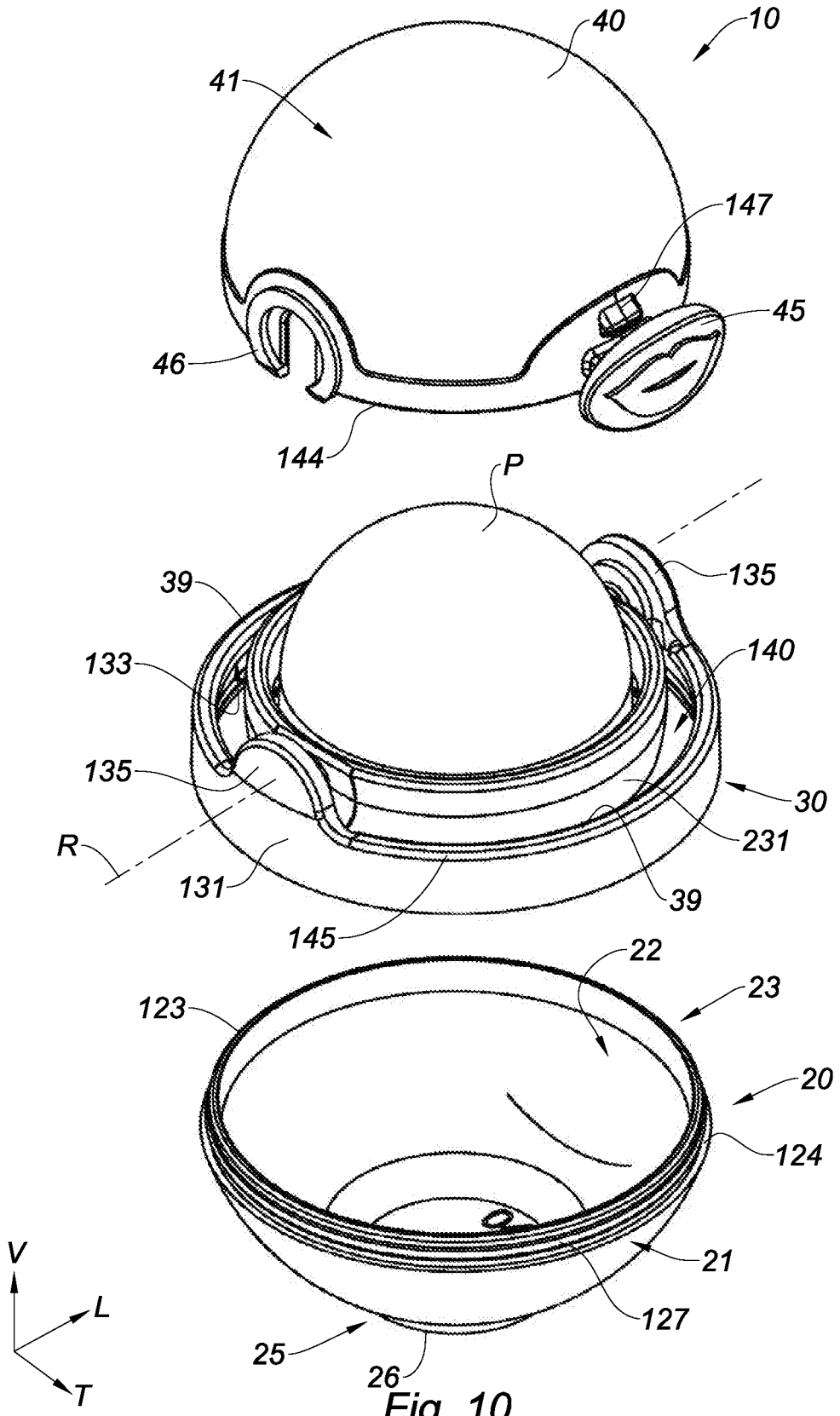
Figure 11:
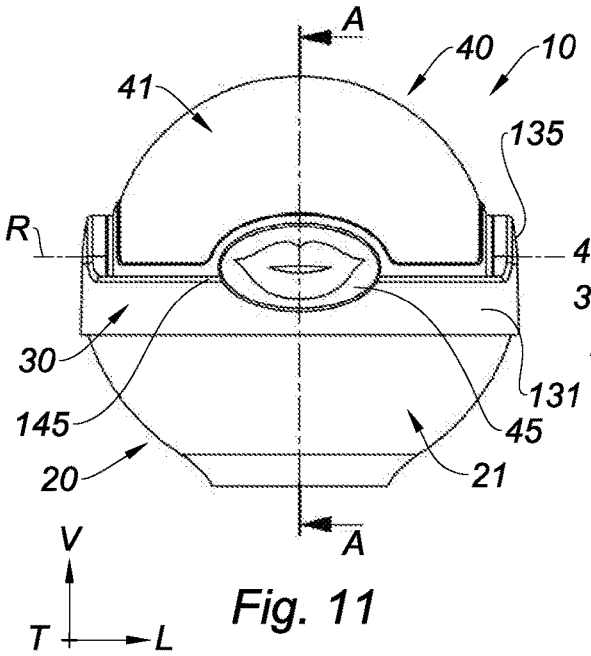
Figure 12:
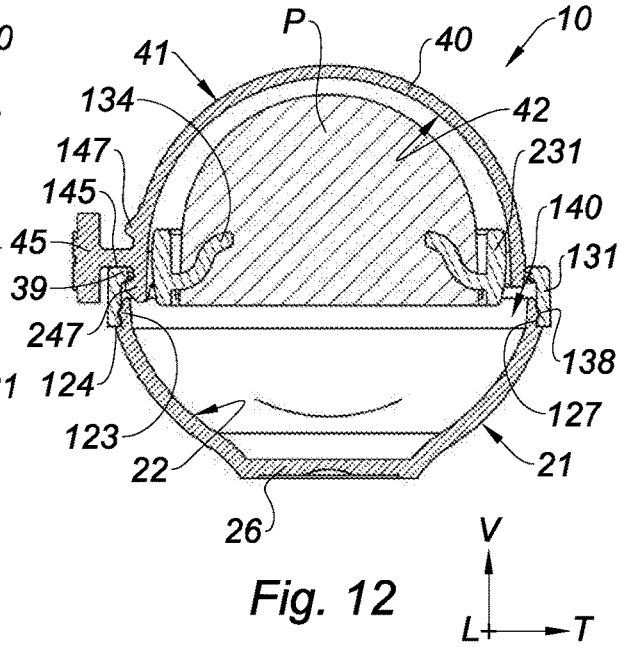
Figure 13:
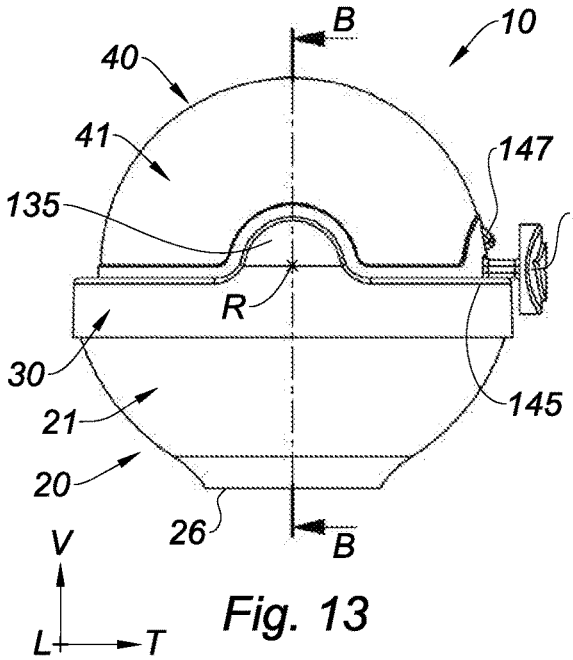
Figure 14:
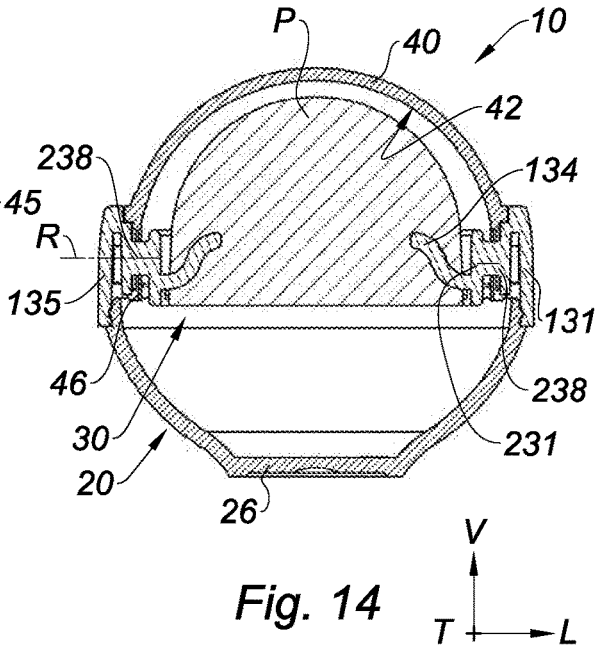
Figure 15:
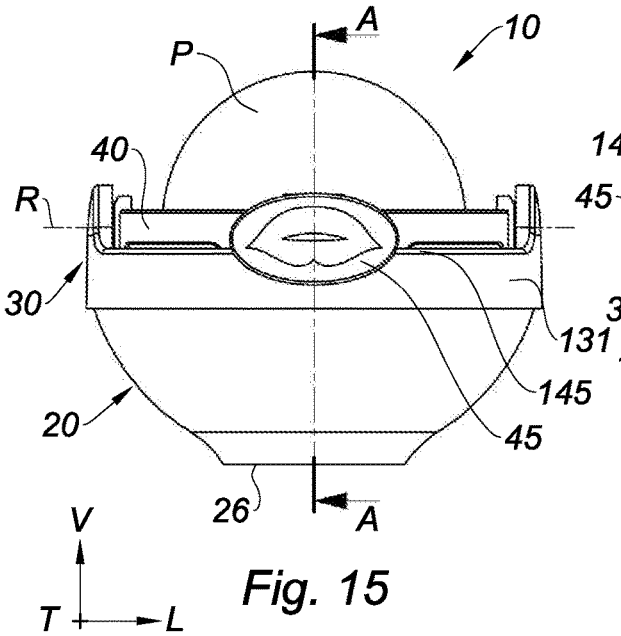
Figure 16:
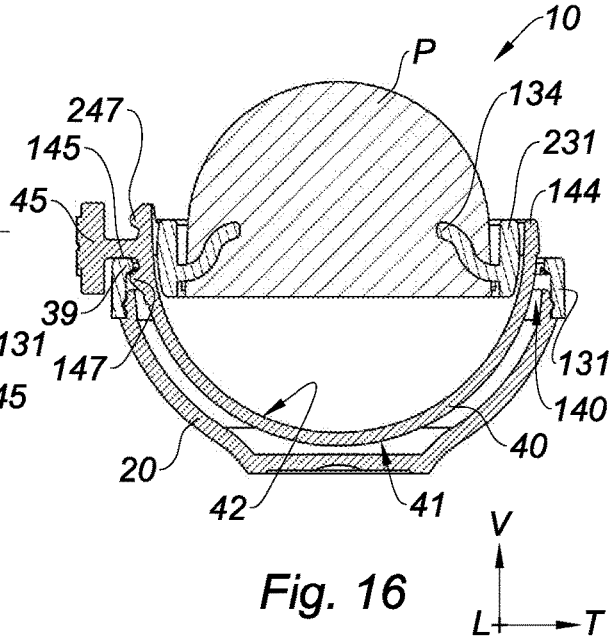
Figure 17:
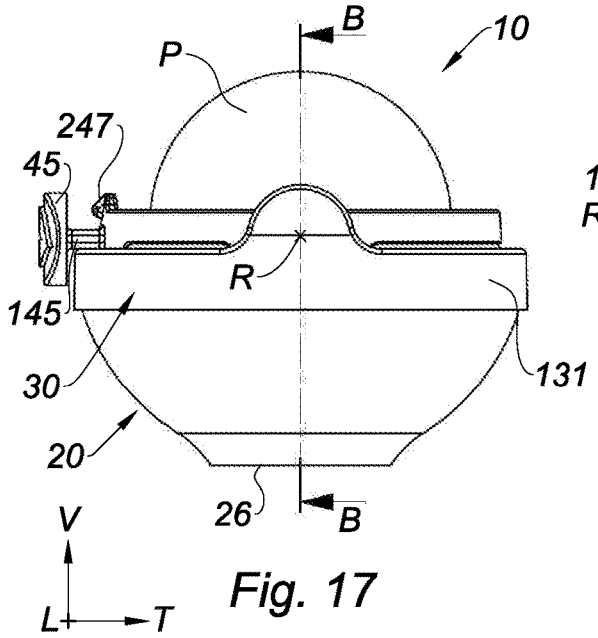
Figure 18:
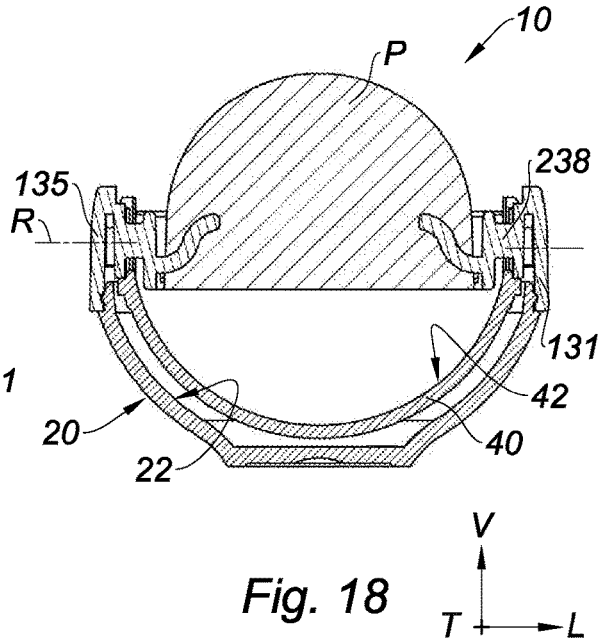
Figure 19:
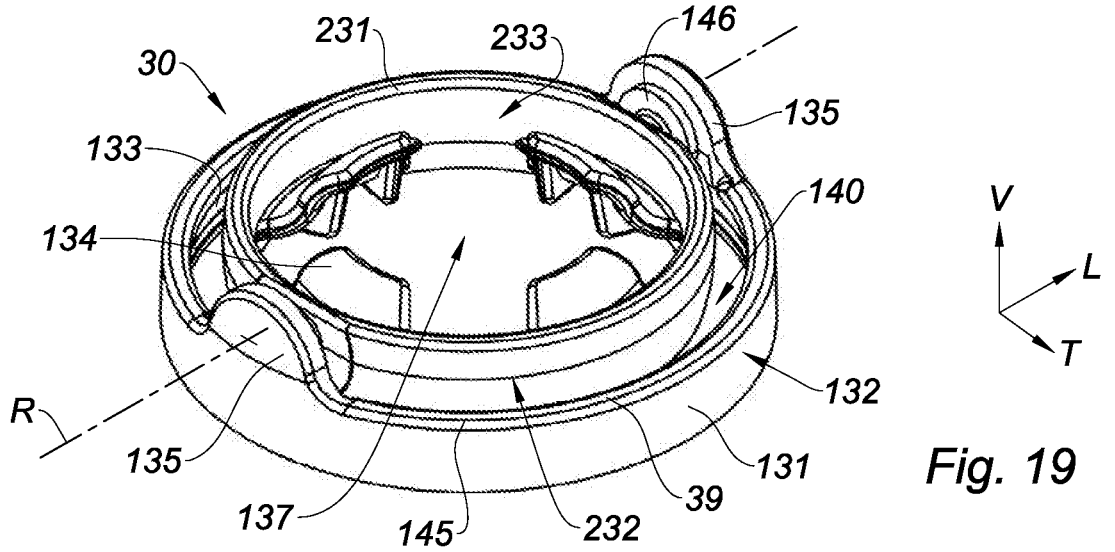
Figure 20:
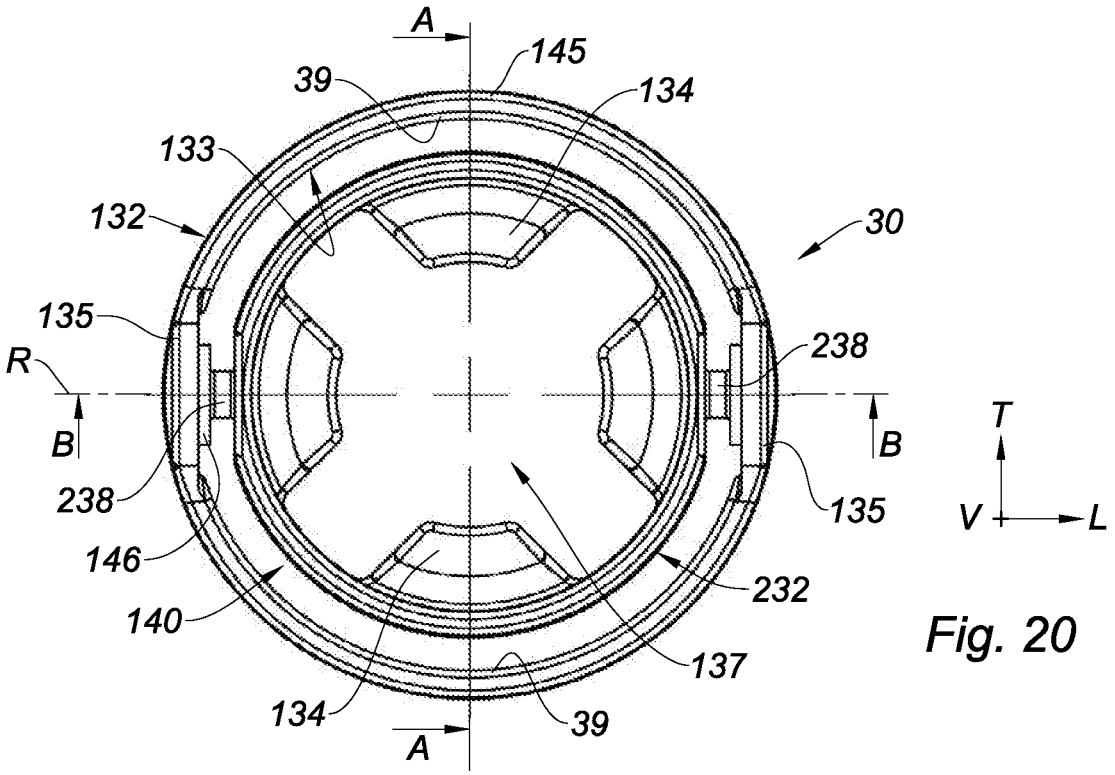
Figure 21:
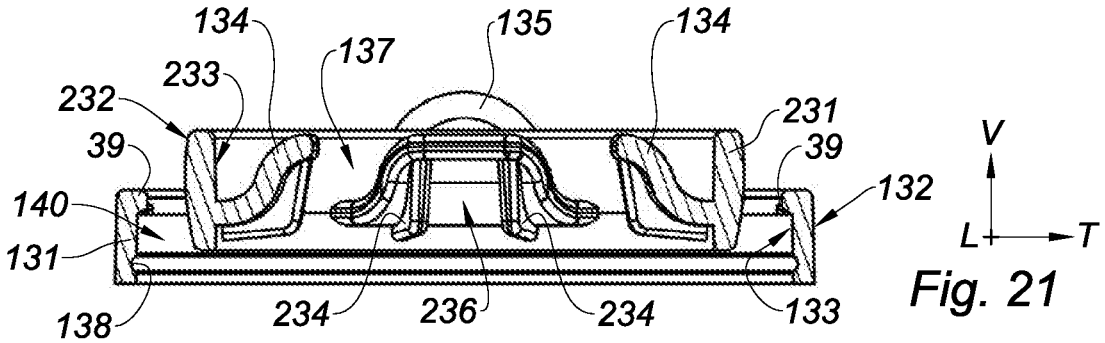
Figure 22:
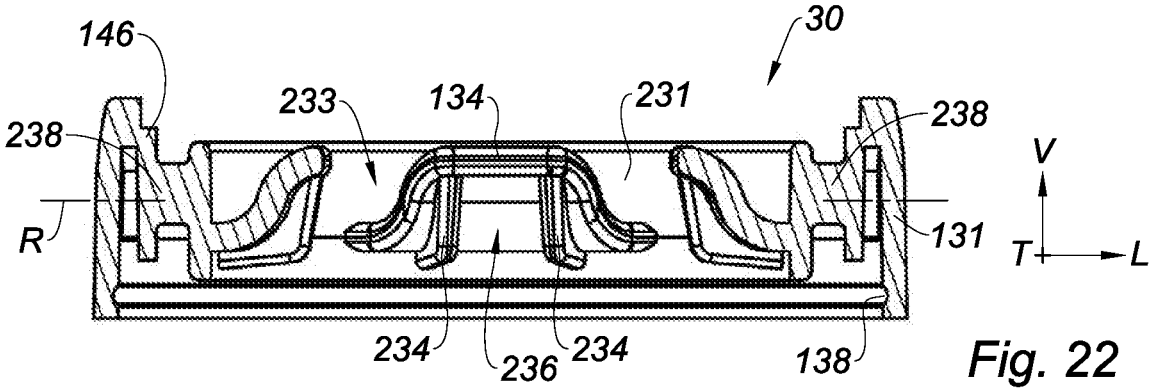
Figure 23:
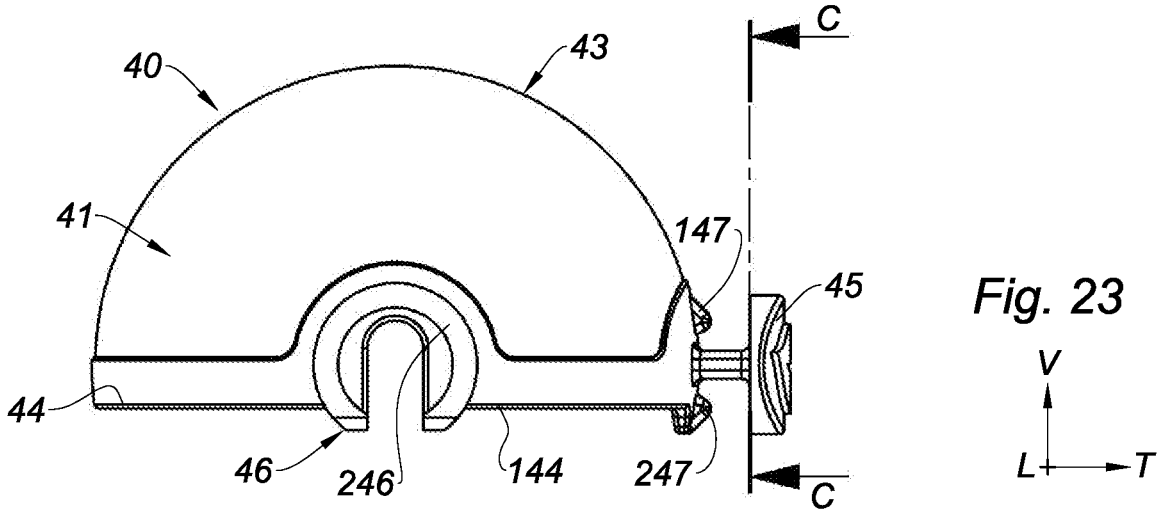
Figure 24:
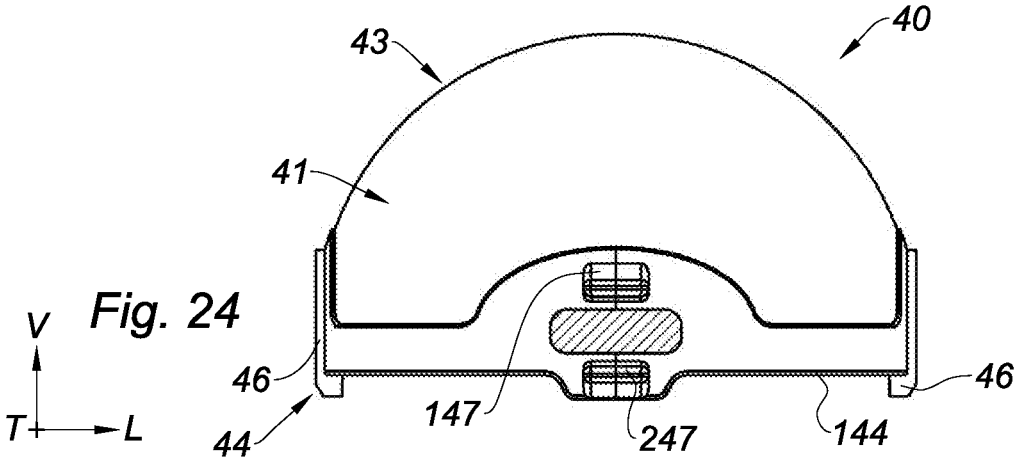

The invention will be better understood, and other purposes, details, characteristics and advantages of this invention will become clearer upon reading the following detailed explanatory description of at least one embodiment of the invention, provided by way of an example and not limited thereto, and with reference to the appended schematic drawings, wherein:

FIG. 1A is a perspective view which represents a packaging device according to a first embodiment and which illustrates the device with the lid in a closed position, FIG. 1B is an exploded view of the main components of the device of FIG. 1A, FIG. 1C is a cross-section of the device of FIG. 1A along a vertical and longitudinal plane intersecting with the axis R of rotation of the lid, FIG. 2A illustrates the packaging device of FIG. 1A with the lid in an opened position, FIG. 2B is an exploded view of the main components of the device of FIG. 2A, FIG. 2C is a cross-section of the device of FIG. 2A along a vertical and longitudinal plane intersecting with the axis R of rotation of the lid, FIG. 3A is a perspective view of the base of the packaging device of FIG. 2B, FIG. 3B is a detailed view of the male fastening means of FIG. 3A, FIG. 4A is a rear view of the intermediate part of the packaging device according to the first embodiment, FIG. 4B is a side view of the intermediate part of the packaging device of FIG. 2B, FIG. 4C is a bottom view of the intermediate part of the packaging device according to the first embodiment, FIG. 4D is a bottom perspective view of the intermediate part of the packaging device according to the first embodiment, FIG. 4E is a detailed view of the protrusion of matter protruding from the intermediate part of the packaging device according to the first embodiment, FIG. 5A is a side view of the lid of the packaging device according to the first embodiment, FIG. 5B is a first perspective view of the lid of the packaging device according to the first embodiment, FIG. 5C is a second perspective view of the lid of the packaging device according to the first embodiment, FIG. 6A is a cross-section along a vertical and transversal plane of the packaging device with the lid in a closed position along a median transversal and vertical plane intersecting with the blocking means, FIG. 6B is a detailed view of FIG. 6A, FIG. 7A is a cross-section of the packaging device with the lid in an opened position along a median transversal and vertical plane intersecting with the blocking means, FIG. 7B is a detailed view of FIG. 7A, FIGS. 8 and 9 are perspective views which represent a packaging device according to a second embodiment and which illustrate the device with the lid in a closed position and in an opened position respectively, FIG. 10 is an exploded view of the main components of the packaging device according to this second embodiment, FIGS. 11 and 12 are respectively a front view and a cross-section view along the vertical A-A plane which, represented in FIG. 11, intersects with the blocking means of the packaging device, with the lid in a closed position, FIGS. 13 and 14 are respectively a side view and a cross-section view along the vertical B-B plane which, represented in FIG. 13, intersects with the axis R of rotation of the lid of the packaging device according to FIGS. 8 to 10, with the lid in a closed position, FIGS. 15 and 16 are respectively a front view and a cross-section view along the vertical A-A plane which, represented in FIG. 14, intersects with the blocking means of the packaging device, with the lid in an opened position, FIGS. 17 and 18 are respectively a side view and a cross-section view along the vertical B-B plane which, represented in FIG. 17, intersects with the axis R of rotation of the lid of the packaging device according to FIGS. 8 to 10, with the lid in an opened position, FIGS. 19 and 20 are respectively a perspective view and a top view which represent in detail the intermediate part of the device according to the second embodiment, FIGS. 21 and 22 are cross-section views along the planes A-A and B-B of FIG. 20 which represent the intermediate part of the device according to the second embodiment, FIGS. 23 and 24 are respectively a side view of the lid of the device according to the second embodiment and a cross-section view along the plane C-C represented in FIG. 23 which illustrates in detail the first and second lugs intended to cooperate with the protrusion of the intermediate part to block the lid in a closed and in an opened position.

In the following description, elements and components presenting identical, analogue or similar structures or functions are designated by the same references.

In the following description, conventionally and in a non-limiting manner, the longitudinal, vertical and transversal orientations are in reference to the trihedron (L, V, T) represented in all of the figures. The vertical direction is used as a geometric reference with respect to the direction of the earth's gravity. The axis (R) of rotation is horizontal in the longitudinal direction L.

Conventionally, the longitudinal and transversal directions are determined in a fixed manner with respect to the base of the device so that the opened or closed position of the device is of no incidence on said orientations.

The terms "left" and "right" are also used in a non-limiting manner with reference to the longitudinal orientation, also the terms "upper" and "lower" and "top" and "bottom" are used with reference to the vertical orientation, and finally the terms "front" and "rear" are used with reference to the transversal orientation, the front of the device presenting a gripping means of the lid in a closed position.

The terms "inner" or "outer" and "internal" or "external" are respectively used with respect to the device in a general manner and more particularly with respect to the intermediate part and to the base of the device, especially to describe an element either located inside, or outside of the intermediate part or of the base.

Although it is more particularly intended for the application of lipstick or lip balm, the invention can also be packaged for any other type of cosmetic product that can be packaged in a solid or pasty form i.e. that does not spread in the open air, especially eye shadow, foundation, perfume, or products of the deodorant- or antiperspirant-type.

A first embodiment of a packaging device 10 according to the invention will be described below, as illustrated especially in FIGS. 1A to 7B.

The packaging device 10 is intended to be used to package a cosmetic product P, especially a solid or pasty cosmetic product.

The packaging device 10 for a cosmetic product comprises a base 20, an intermediate part 30 intended to carry the cosmetic product P and a lid 40.

The intermediate part 30 is secured to the base 20 by attachment means. Preferably, securing the intermediate part 30 to the base 20 is achieved by form-fitting, for example by elastic coupling (or "snap-fitting").

In another version, securing the intermediate part 30 to the base 20 is achieved by screwing, gluing or any other equivalent attachment means.

The attachment means according to the first embodiment are described in further detail below. The attachment means are able to connect axially at least, along the vertical direction, the intermediate part 30 to the base 20.

According to the attachment means used, the intermediate part 30 and the base 20 are also rotationally blockable or not with respect to one another.

The packaging device 10 can comprise rotational blocking means of the intermediate part 30 with respect to the base 20, said blocking means being separate from the attachment means.

In this first embodiment, the intermediate part 30 is mounted in the base 20, the intermediate part 30 being partly received inside the base 20.

The lid 40 is mounted to be rotationally mobile with respect to the intermediate part 30, secured to the base 20, by hinging means. The lid 40 is mounted hinged on the intermediate part 30 so that the lid 40 occupies two positions, a first position, called the closed position of the device as illustrated in FIGS. 1A to 1C, wherein the base 20 and the lid 40 together define a substantially closed space, and a second position, called the opened position of the device as illustrated in FIGS. 2A to 2C, wherein the lid 40 is retracted inside the base 20.

Preferably, the device 10 is of substantially spherical form. In another version that is not represented, the device according to the invention can have a substantially cylindrical form with rounded surfaces, an egg form, an oval form or analogues.

Preferably, the base 20 illustrated in FIG. 3A is made of a plastic material selected especially from the group comprising acrylonitrile butadiene styrene (ABS), polypropylene (PP) or styrene-acrylonitrile (SAN). The base if manufactured by moulding.

The base 20 substantially has a hollow half-sphere form and presents an outer face 21 and an inner face 22. Advantageously, the inner face 22 is smooth. The outer face 21 is smooth or it can be embossed. The outer face 21 can also be decorated, i.e. it can comprise elements customising the device 10.

Along the vertical axis V, the base 20 comprises a first upper end 23 of the base 20 which is circumferentially delimited by an edge 123. This upper end 23 of the base 20 is vertically open upwards so as to receive the intermediate part 30.

Furthermore, close to the upper end 23 of the base 20 and more particularly on the lower face 22 of this upper end 23 of the base 20, it can be seen a groove 24 is provided and designed to receive the intermediate part 30. This groove 24, forming a shoulder, is found over substantially present on the entire circumference of the base 20. The width of the groove 24, along the vertical axis V, is adapted to correspond to the width of a rim 31 of the intermediate part 30.

Along the vertical axis V, the base 20 also presents a second lower end 25 of the base 20 enabling the gripping of the device 10 according to the invention during the application of make-up, the lower end 25 of the base 20 further comprising a structure 26, forming a bottom, is designed so as to enable the stable positioning of the device 10 on a complementary surface, for example a flat surface, especially a make-up table, a table, or a counter.

The base 20 comprises at least two fastening means 27, in this case male, intended to cooperate with at least two fastening means 38, in this case female, provided on the intermediate part 30, so that the intermediate part 30 is secured to the base 20 in closed and opened positions of the device 10. In this first embodiment, the fastening means 27 and 38 constitute an example of attachment means to secure the intermediate part 30 to the base 20, in a reversible manner or not.

As illustrated in FIGS. 3A and 3B, each one of the two male fastening means 27 located on the base 20 comprises, on one hand, a centring guide 28 and, on the other hand, side housings 29 with respect to the centring guide 28.

The two male fastening means 27 are positioned substantially at the level of the groove 24. In other words, the two male fastening means 27 are located at the level of the inner face 22 of the upper end 23 of the base 20.

The centring guide 28 is intended to be housed in a cavity 38-3 cut out from the matter of a head 38-1 of the female fastening means 38 of the intermediate part 30 so as to ensure the positioning of the intermediate part 30 on the base 20.

The centring guide 28 can have a form that fits with the form of the cavity 38-3. Therefore, the technical form of the centring guide 28 is adapted so that it can be inserted or housed in the corresponding form of the cavity 38-3. Advantageously, the technical form of the centring guide 28, and consequently of the cavity 38-3, is not a form that allows turning so as to prevent any rotation of the intermediate part 30 with respect to the base 20.

More particularly, the centring guide 28 can have a polygonal form, especially a substantially square, rectangular or triangular form. Therefore, the various sides created by the numerous angles of these polygons enable the non-rotation of the intermediate part 30 with respect to the base 20.

As for the side housings 29, they present a form complementary with that of the tabs 38-2 of each one of the female fastening means 38 of the intermediate part 30 so that the housings 29 and the tabs 38-2 cooperate to maintain the intermediate part 30 in position in the base 20.

The non-turning form of the centring guide 28 and the presence of side housings 29 at the level of the base 20 enable—when they cooperate respectively with the cavity 38-3 and the tabs 38-2 of the intermediate part 30—to prevent all rotation of the intermediate part 30 with respect to the base 20.

In this first embodiment, the device 10 advantageously comprises rotational blocking means that are further formed by the centring guide 28.

In another version that is not represented, each of the two fastening means 27 located on the base 20, is a female attachment means intended to cooperate with of one of the two male fastening means provided on the intermediate part 30, so that the intermediate part 30 is secured to the base 20 in closed and opened positions of the device 10.

According to the trihedron (L, V, T) represented in FIG. 1B, the two fastening means 27 are arranged longitudinally to the left and right with respect to the base 20 of the device 10. Therefore, the two attachment means 27 are located diametrically opposite one another longitudinally.

As illustrated in FIGS. 1B, 2A and 2B, the device 10 comprises an intermediate part 30 intended to carry the cosmetic product P, said cosmetic product P being made accessible in an opened position of the device 10.

Preferably, the intermediate part 30 is made of a plastic material selected especially from the group comprising acrylonitrile butadiene styrene (ABS), polypropylene (PP) or styrene-acrylonitrile (SAN). The intermediate part 30 is manufactured by moulding.

As illustrated in FIGS. 4A to 4D, the intermediate part 30 comprises at least one rim 31 that comprises an outer face 32 and an inner face 33.

In this first embodiment, the intermediate part 30 globally has the form of a wheel.

The intermediate part 30 comprises radially on the inside retaining means that are intended to be engaged with the cosmetic product P, recessed in a block of solid or pasty cosmetic product P.

The intermediate part 30 comprises a plurality of spokes 34 that extend from a hub 35 to end at reach the inner face 33 of the rim 31.

The spokes 34 extend from the hub 35 at equal angles to connect to the inner face 33 of the rim 31, in other words the spokes 34 are distributed circumferentially in a regular manner. The spokes 34 and the hub 35 constitute retaining means that are intended to be recessed, after casting, in a block of cosmetic product P in order to form a unitary sub-unit.

The width of the spokes 34 and the diameter of the hub 35 are chosen to create an adequate zone 36 on which the cosmetic product P is, in this case, cast. This zone 36 on which the cosmetic product P is cast, is circular when the device 10 is substantially spherical. This zone 36 comprises a lower face 36-1 and an upper face 36-2.

The cosmetic product P is advantageously cast upside down on the zone 36 of the intermediate part 30, i.e. it is cast from the lower face 36-1 towards the upper face 36-2 of the zone 36 according to a hot-poured casting technique.

Therefore, the presence of gaps 37 between the spokes 34 determines at least one opening enabling the passage of the cosmetic product P through the intermediate part 30 whose spokes 34 then enable to retain the cosmetic product P secured to the intermediate part 30.

Furthermore, along the vertical axis V, the zone 36 delimited by the rim 31 is recessed with respect to the height of the rim 31. The zone 36 is at mid-height of the rim 31. As for the hub 35, it is raised along the vertical axis V, i.e. in a side view as illustrated in FIG. 4A, it extends beyond an upper end of the rim 31 so as to stabilise the cast cosmetic product P. In this first embodiment, the rim 31 and the hub 35 are therefore not coplanar and the spokes 34 connecting them present a slope along a vertical direction.

In another version, according to an embodiment that is not illustrated, the cosmetic product P can be cast through the upper face 36-2 of the zone 36 of the intermediate part 30. In this case, the zone 36 delimited by the rim 31 can be full, i.e. not comprise any spokes 34. To secure and stabilise the cast cosmetic product P, small notches are then present on the periphery of the inner face 33 of the rim 31.

The intermediate part 30 further comprises at least two fastening means 38 located on the outer face 32 of the rim 31. The two fastening means 38 provided on the intermediate part 30 are designed to ensure the positioning and maintaining of the intermediate part 30 in the base 20 on one hand, and to ensure the pivoting of the lid 40 about an axis of rotation (R) on the other hand, thereby enabling the transition from the opened position to an closed position of the device 10, and inversely.

Each of the two fastening means 38 provided on the intermediate part 30 is a female fastening means. In another version that is not represented, each of the two fastening means 38 provided on the intermediate part 30 can be a male fastening means.

As illustrated particularly in FIGS. 4B and 4D, each of the two female fastening means 38 provided on the intermediate part 30 comprises a head 38-1 and two tabs 38-2 located on either side of the head 38-1, as well as a cavity 38-3 cut out from the matter of the head 38-1. The cavity 38-3 is configured to receive one of the two male fastening means 27 of the base 20, and more particularly the centring guide 28 of the male fastening means 27.

The head 38-1 of the two fastening means 38 provided on the intermediate part 30 presents a rounded shape. Preferably, the two fastening means 38 provided on the intermediate part 30 present an omega shape (Ω).

The head 38-1 of the two fastening means 38 provided on the intermediate part 30 presents a thickness, measured along the longitudinal axis L, sufficient to enable the passage of the lid 40.

The thickness of the lid 40 enables the latter to pivot along a rotational movement about an axis (R) of rotation defined by at least two fastening means 38 located at the level of the intermediate part 30 and forming the hinging means of the lid 40. More particularly, the pivoting by rotation is achieved through the head 38-1 of the fastening means 38 so that the lid 40 can be housed in the base 20 of the device 10.

The intermediate part 30 further comprises blocking means enabling to retain the lid 40 in an opened position—reciprocally in a closed position.

As illustrated in FIGS. 4A to 4E, and 6A, 6B, 7A and 7B, the blocking means are provided in the form of at least one protrusion 39 of matter protruding from the intermediate part 30.

The said at least one protrusion 39 of matter is intended to cooperate with the lid 40, the transition from the closed position to the opened position and inversely being performed with a limited effort, applied to the lid 40, so as to unblock the lid 40 from its position, advantageously without having to resort to an external tool.

In this first embodiment, the intermediate part 30 comprises a protrusion 39 of matter that globally has the form of a hook as illustrated in FIG. 4E.

According to the trihedron (L, V, T) represented in FIG. 1B, the two fastening means 38 are arranged longitudinally, respectively to the left and right with respect to the intermediate part 30 of the device 10, as are the fastening means 27 with respect to the base 20. The two attachment means 38 are thus located diametrically opposite one another longitudinally. As for the protrusion 39 of matter, it protrudes from the outer face 32 of the rim 31, and more particularly the protrusion 39 of matter is located transversally at the rear of the outer face 32 of the rim 31.

Aesthetically, the tabs 38-2 and the corresponding side housings 29 are invisible to the eye of the user during the use of the cosmetic product P, as they are concealed in the base 20 of the device 10.

As illustrated in FIGS. 1A and 2A, the device 10 comprises a lid 40 that is mounted rotationally mobile on the intermediate part 30.

The lid 40 is mounted hinged so as to occupy two positions, a first position, called closed position device 10, wherein the base 20 and the lid 40 together define a substantially closed space and a second position, called opened position of the device 10, wherein the lid 40 is retracted, by a rotational movement about an axis (R) of rotation, inside the base 20.

Furthermore, the lid 40 is configured to be blocked in an opened position and reciprocally in a closed position of the packaging device 10.

Preferably, the lid 40 is made of a plastic material selected especially from the group comprising acrylonitrile butadiene styrene (ABS), polypropylene (PP) or styrene-acrylonitrile (SAN). The lid 40 is manufactured by moulding.

As illustrated in FIGS. 5A to 5C, the lid 40 substantially has a hollow half-sphere form and presents an outer face 41 and an inner face 42.

Advantageously, the inner face 42 of the lid 40 is smooth. The inner face 42 is not embossed so as to avoid damaging the surface of the cosmetic product cast and housed inside, in a closed position of the device 10.

However the inner face 42 of the lid 40 presents a notch designed 47 to receive, at the end of the motion of the lid 40, the protrusion 39 of matter protruding from the intermediate part 30 so as to retain the lid 40 in an opened position.

More particularly and as illustrated in FIG. 5C, the notch 47 is located on the inner face 42, transversally at the front of the lid 40 in a closed position of the device 10.

The outer face 41 is smooth or it can be embossed. The outer face 41 can also be decorated, i.e. it can comprise elements customising the device.

Along the vertical axis V, the lid 40 comprises a first end, called upper end 43 of the lid 40. This upper end 43 of the lid 40 is closed.

Along the vertical axis V, the lid 40 comprises a second end, called lower end 44 of the lid 40. This lower end 44 of the lid 40 is opened so as to cover and protect the cosmetic product P in a closed position P of the device 10.

The notch 47 is positioned in the vicinity of an edge 144 of the lower end 44 of the lid 40.

Close to the lower end 44 of the lid 40 and more particularly transversally at the front on the outer face 41 of this lower end 44 of the lid 40, a gripping means 45 is intended to enable the handling of the lid 40.

The gripping means 45 is advantageously used to move the lid 40 from its opened position to its closed position, and inversely.

In this first embodiment, the gripping means 45 forming a handle is here in the shape of a hook, substantially with an "L" shape.

The gripping means 45 is intended to come to rest against the base 20, in this case.

The gripping means 45 is intended to serve as a stop to immobilise the motion of the lid 40 in a closed position and in an opened position, by contact with the edge 123 of the base 20.

The lid 40 is configured to pivot according to a rotational movement about an axis (R) of rotation defined by at least two fastening means 38 forming the hinging means located on the intermediate part 30. More particularly, the pivoting by rotation of the lid 40 is achieved through the head 38-1 of the fastening means 38 so that the lid 40 can be housed in the base 20 of the device 10, i.e. inside the base 20.

The lid 40 comprises two connecting zones 46. The two connecting zones 46 located on the lid 40 each present a complementary form to that of the head 38-1 of the female fastening means 38 located at the level of the intermediate part 30, so as to ensure the articulation of the lid 40 on the intermediate part 30 and to enable the lid 40 to pivot from its closed position to its opened position, and inversely.

Furthermore, the specific shape of the fastening means 38, i.e. the omega shape (Ω), contributes to facilitate the assembly of the lid 40 on the fastening means 38 of the intermediate part 30.

The omega shape (Ω) thereby reduces the risk of breakage of the connecting zones 46 located on the lid 40 during the insertion of the fastening means 38 in the connecting zones 46, while enabling the hinging of the lid 40 on the intermediate part 30, thanks to the rounded form of the head 38-1, which fits with the complementary form of said connecting zones 46 of the lid 40.

According to the trihedron (L, V, T) represented in FIG. 1B, the two connecting zones 46 are arranged longitudinally to the left and right with respect to the lid 40 of the device 10, as are the male fastening means 27 with respect to the base 20 and the female fastening means 38 with respect to the intermediate part 30.

Therefore, the two connecting zones 46 are located diametrically opposite one another longitudinally. The gripping means 45 is arranged perpendicularly to one or the other of the two connecting zones 46 on the lid 40, in this case in the middle of the two connecting zones 46.

Finally, the notch 47 and the protrusion 39 of matter are located diametrically opposite one another, along the transversal axis (T), in a closed position of the device 10, in other words the notch 47 and the protrusion 39 of matter are diametrically opposite one another in a closed position of the device 10.

As illustrated in FIGS. 6A and 6B, in a closed position of the device, the protrusion 39 of matter abuts against the lid 40.

The lid 40 is thereby blocked in a closed position thanks to the protrusion 39 of matter that cooperates with the lid 40 to retain it in a closed position. It should also be noted that the notch 47 is located transversally at the front of the device 10, on the inner face 42 of the lid 40, in the vicinity of the edge 144.

Advantageously, the passage from the closed position to the opened position is achieved with limited effort, applied on the lid 40, so as to release the lid 40 from its initial position. The user releases the lid 40 with the gripping means 45 located transversally at the front in a closed position of the device 10.

During the progressive pivoting of the lid 40 inside the base 20 from the closed position to the opened position, the protrusion 39 of matter, protruding from the intermediate part 30, continuously abuts against the inner face 42 of the lid 40. Therefore, a continuous force is applied between the protrusion 39 of matter and the inner face 42 of the lid 40 during the pivoting of the lid 40 from the closed position to the opened position.

During the handling of the lid 40, between closed and opened positions, the protrusion 39 of matter cooperates with the inner face 42 of the lid 40.

As illustrated in FIG. 4E, the protrusion 39 of matter is made of a bracket integrally formed with the intermediate part 30. Therefore, when handling the lid 40, a constraint is permanently applied on the bracket comprising the protrusion 39 of matter, said constraint no longer being applied when one or the other of said closed or opened positions is reached by the lid 40.

Thanks to the constraint and friction applied between the protrusion 39 of matter and the inner face 42 of the lid 40, the pivoting movement of the lid 40 during its motion between closed and opened positions and reciprocally can be controlled.

Indeed, when the opened position of the lid 40 is reached for example, the protrusion 39 of matter is then received in the notch 47 hollowed out from the inner face 42, and no longer undergoes a constraint.

The lid 40 is then blocked in an opened position by the protrusion 39 of matter when the operation in the opposite direction, to pivot the lid 40 from its opened position to its closed position, can only be performed by applying on the lid 40 a force sufficient to release the protrusion 39 of matter from the notch 47, by applying a constraint on it against the inner face 42 of the lid 40.

Of course, the description provided for the opening operation of the lid 40 of the device 10 is also applicable for the closing operation.

At the end of the motion during a closing operation, the protrusion 39 of matter is no longer constrained when it passes the edge 144 of the lower end 44 of the lid 40 and the blocking of the lid 40 is then achieved.

Indeed, the user must then apply a sufficient force on the lid 40 so that the protrusion 39 of matter once again passes the edge 144 of the lid 40 and, so that, in contact with the inner face 42, said protrusion 39 of matter carried by the bracket undergoes a constraint.

As illustrated in FIGS. 7A and 7B, in a fully opened position, i.e. when the lid 40 has arrived at the end of its motion and is retracted inside the base 20, the gripping means 45 determines the end of motion of the lid 40 by abutting at the rear of the device against the edge 123 of the base 20.

The protrusion 39 of matter, which no longer abuts against the inner face 42 of the lid 40, is then located inside the notch 47, which blocks the lid 40 in an opened position.

To pass from the opened position to the closed position, the user must apply a force preferably using the gripping means 45 to release the lid 40, i.e. to cause the protrusion 39 of matter to exit from the notch 47.

Then the protrusion 39 of matter is again in permanent abutment against the inner face 42 of the lid 40, until the gripping means 45 abuts at the front of the device on the edge 123 of the base 20.

At that moment, the protrusion 39 of matter resumes its starting position, i.e. it abuts against the lid 40 as illustrated in FIGS. 6A and 6B, positioned under the edge 144 of the lid 40.

In this first embodiment, the lid 40 is therefore able to occupy at least one intermediate position between the opened and closed positions.

The intermediate position is a stable position, the lid 40 being maintained in position by friction caused by the force exerted by the protrusion 39 against the inner face 42 of the lid 40.

Below is the description of a second embodiment according to the invention of a packaging device 10 for a cosmetic product P, especially for a solid or pasty cosmetic product.

The description of this second embodiment illustrated in FIG. 8 and following is advantageously made by comparison with that of the first embodiment so that similar references are made to elements presenting an identical structure or function.

The packaging device 10 for a cosmetic product P mainly comprises a base 20, an intermediate part 30, and a lid 40, especially illustrated in an exploded view in FIG. 10.

The intermediate part 30 is intended to form a support for the cosmetic product P, for example a block with which the intermediate part 30 forms, after casting of the product, a unitary sub-unit.

The intermediate part 30 is secured to the base 20. In this second embodiment, the attachment means between the intermediate part 30 and the base 20 are achieved by elastic coupling or by "snap-fitting".

At its upper end 23, the base 20 comprises an edge 123 provided with at least one annular bulge 127 that extends, protruding outwards, from the outer face 21. As illustrated in FIG. 10, the bulge 127 is circumferentially continuous, and in another version discontinuous. The edge 123 also comprises a shoulder 124 provided in its outer face 21.

The bulge 127 constitutes a male fastening means intended to cooperate with a complementary female fastening means, in this case a groove 138.

The intermediate part 30 therefore comprises at least one groove 138 forming a female fastening means. Obviously, the fastening means can be inverted so that the base 20 comprises a male fastening means, such as a bulge, and the female fastening means, such as a groove, is provided on the intermediate part 30.

In this second embodiment, the intermediate part 30 presents a design that is different from that of the first embodiment. The intermediate part 30 comprises two concentric rims, respectively an outer rim 131 and an inner rim 231.

The outer rim 131 comprises respectively an outer face 132 and an inner face 133, whereas the inner rim 231 comprises an outer face 232 and an inner face 233.

The groove 138 is provided on the inner face 133 of the outer rim 131. When the intermediate part 30 and the base 20 are assembled by elastic coupling, the bulge 127 of the base 20 is then received in the groove 138.

Advantageously, the attachment of the intermediate part 30 to the base 20 achieved in this case by elastic coupling is a reversible operation, enabling a subsequent disassembly. This disassembly can, for example, enable to change the intermediate part 30 carrying the cosmetic product P, especially for the purpose of refilling the device 10 when the cosmetic product P has been completely used.

By comparison with the first embodiment, the intermediate part 30 and the base 20 are not rotationally blocked with respect to one another. As indicated above, the rotational blocking of the intermediate part 30 with respect to the base 20 can result from the choice of the attachment means, or be obtained by separate means.

The outer rim 131 is arranged outside the base 20 and is positioned at the level of the edge 123 of the base 20, whereas the inner rim 231 extends radially inside the base 20.

The outer rim 131 advantageously forms a belt that surrounds the upper end 23 of the base 20.

The lid 40 is mounted hinged on the intermediate part 30, said lid 40 being mounted to be rotationally mobile about the axis R of rotation that extends along the longitudinal direction of the trihedron (L, V, T).

In this second embodiment, the outer rim 131 and the inner rim 231 of the intermediate part 30 are connected to one another at least by hinging means. The hinging means are formed by two trunnions 238 that determine said axis R of rotation of the lid 40.

As in the first embodiment, the lid 40 comprises two connecting zones 46 that are intended to be mounted on the trunnions 238 to ensure the rotational mounting of the lid 40 about the axis R.

Advantageously, the outer rim 131 of the intermediate part 30 comprises two flanges 135 arranged at the level of the trunnions 238 and each intended to conceal, for aesthetic purposes, after the lid is mounted on the intermediate part 30, one of said connecting zones 46.

The outer rim 131 and the inner rim 231 of the intermediate part 30 delimit together an opening 140 configured to enable the passage of the lid 40, especially its retraction inside the base 20 during an opening operation, from the closed position to the opened position of the device 10.

As illustrated in the cross-section view of FIG. 21, the outer rim 131 and the inner rim 231 of the intermediate part 30 are not coplanar, the inner rim 231 being vertically offset upwards with respect to the outer rim 131.

As shown in FIGS. 8 and 9, the lid 40 is able of occupying at least two positions:

- a first position, called closed position of the device 10, wherein the base 20 and the lid 40 define together a substantially closed space that is especially illustrated in FIGS. 11 and 13, and
- a second position, called opened position of the device 10, wherein the lid 40 is retracted inside the base 20 and that is especially shown in FIGS. 15 and 17.

The lid 40 is configured to be blocked in an opened position and reciprocally in a closed position, by means of the blocking means. The blocking means carried by the intermediate part 30 are intended to cooperate with said lid 40 to selectively provide the blocking in a given position.

According to the invention, the blocking means comprise at least one protrusion 39 of matter protruding from the intermediate part 30.

More precisely, said at least one protrusion 39 extends and protrudes from the inner face 133 of the outer rim 131 of the intermediate part 30.

By comparison with the first embodiment, said at least one protrusion 39 of matter is, in this case, not in contact with the inner face 42 of the lid 40 during opening or closing operations, so that the lid 40 is free between said closing and opening positions.

Advantageously, the hinging means of the lid 40 are configured to enable the controlling of the pivoting of the lid, so that the motion is performed progressively. Furthermore, the hinging means of the lid 40 formed by each connecting zone 46 engaged on a trunnion 238 are for example configured to achieve friction, so as to prevent sudden pivoting of the lid 40.

Thanks to integrating controlled friction at the level of the hinging means of the lid 40 on the intermediate part 30, it is possible to control (as in the first embodiment) the pivoting motion of the lid 40 when moving it from a closed position to an opened position and reciprocally.

Advantageously, the device 10 comprises guiding means 146 to guide the lid 40 when it is being moved between its said closed and opened positions, and inversely.

The guiding means 146 are arranged at the level of the hinging means of the lid 40 on the intermediate part 30.

Preferably the guiding means 146 are arranged inside the flanges 135 provided on the outer rim 131 of the intermediate part 30. The guiding means 146 are configured to cooperate with the connecting zones 46 provided on the lid 40.

More particularly visible in FIG. 19, the guiding means 146 present a globally circular shape and are received inside complementary means 246 provided in said connecting zones 46, and more particularly visible in FIG. 23. The complementary means 246 delimit internally a track with which said circular guiding means 146 cooperate.

In the second embodiment, said at least one protrusion 39 of matter is globally circumferentially nearly continuous; indeed, the protrusion 39 is only interrupted at the level of the hinging means of the lid 40 with the intermediate part 30.

The said at least one protrusion 39 of matter protruding from the inner face 133 of the outer rim 131 cooperates with the lid 40 to block said lid 40, respectively in a closed position and in an opened position.

In the second embodiment, said at least one protrusion 39 of matter is engaged with the complementary means secured to the lid 40. Preferably, said complementary means of the protrusion 39 are also formed by a protrusion of matter.

The lid 40 comprises at least a first lug 147 with which said at least one protrusion 39 of matter of the intermediate part 30 is intended to cooperate to block said lid 40 in an opened position.

The lid 40 comprises at least a second lug 247 with which said at least one protrusion 39 of matter of the intermediate part 30 is intended to cooperate to block said lid 40 in a closed position.

In a non-represented variant, the protrusion 39 of matter protruding from the intermediate part 30 cooperates with the complementary means, such as the notches, hollowed out from the outer surface 41 of the lid 40.

As in the first embodiment, the lid 40 comprises a gripping means 45 to enable the handling of the lid 40 so as to move its from its opened position to its closed position, and inversely.

Advantageously, said gripping means 45 is a stop immobilising the motion of the lid 40 in a closed position and in an opened position, as shown in FIGS. 8 and 13, as well as 9 and 17.

The gripping means 45 is configured to ensure a stopping function, and cooperates in this case with an edge 145 of the outer rim 131 of the intermediate part 30 (and not with the edge 123 of the base 20, as in the first embodiment).

Indeed, as described above, the intermediate part 30 is mounted by insertion on the base 20 so that the outer rim 131 covers the edge 123 of the base 20.

The first lug 147 and the second lug 247 of the lid 40 are arranged vertically on either side of said gripping means 45 forming a handle enabling to move the lid 40. The first lug 147 and the second lug 247 of the lid 40 are more particularly visible in FIGS. 23 and 24.

When the user wishes to open the device 10, the lid 40 is moved by means of the gripping means 45 from its closed position to the opened position of the lid 40.

For this, the user has to apply some force to enable the second lug 247 of the lid 40 to pass the protrusion 39 of matter of the intermediate part 30 that, until then, blocked the lid 40 in a closed position.

The lid 40 is then pivoted backwards, rotationally driven by the user around the trunnions 238 to reach the opened position when the first lug 147 passes over the protrusion 39 to block the lid 40 in an opened position.

For the lid 40 to be able to leave the opened position, the user has to apply a suitable force for the first lug 147 to pass the protrusion 39 again in the opposite direction, the lid 40 then being able to be moved freely to the closed position.

The intermediate part 30 comprises retaining means 134, intended to be engaged with the cosmetic product P, which extend radially inside the intermediate part 30 and delimiting together at least one opening 137 to enable the casting of said cosmetic product P.

In this second embodiment, the retaining means are constituted by arms 134, of which there are four in this example, that extend radially inwards, from the inner face 233 of the inner rim 231.

Opposite of the end connected to the inner rim 231, the other end of each arm 134 is free so that the arms 134 together and centrally delimit various gaps forming together said at least one opening 137 intended to enable the casting of the cosmetic product P.

In the absence of the hub 35 of the first embodiment, the opening 137 extends here to the centre of the intermediate part 30 and between each of the arms 134 of said passage opening 137, having globally in this case the shape of a "cross" as illustrated in a top view in FIG. 20.

Advantageously, the arms 134 are provided with at least one rib 234, preferably two ribs 234 that extend vertically from a lower face 236 of each arm 134.

Preferably, the arms 134 extend along a curvilinear profile, globally presenting an "S" shape.

According to a non-represented variant of the second embodiment, the intermediate part 30 comprises at least a protrusion 39 secured to the inner rim 231. Said at least one protrusion 39 extends and protrudes from the outer face 232 of the inner rim 231.

Preferably, said at least one protrusion 39 is not circumferentially nearly continuous over the entire periphery of the inner rim 231, but is made in the form of a pad, advantageously located at the free end of a bracket as in the first embodiment.

In such a variant, the protrusion 39 can be in permanent contact or not, i.e. under constraint, with the inner face 42 of the lid 40 when said lid 40 is moved from closed to opened positions as described above for the first embodiment.

In this version, the lid 40 comprises a portion that fits with said at least one protrusion 39 to form blocking means of the lid 40 in the closed position and in the opened position.

Preferably, the lid 40 then comprises at least one notch provided in the inner face 42 and wherein the protrusion 39 is engaged to block the lid 40 in a given position.

The lid 40 can, for example, comprise two notches made in the inner face 42, said notches being diametrically opposite one another, in this case along the transversal direction, and respectfully associated with the blocking of the lid 40 in one of said closed and opened positions.

The complementary part of the blocking means cooperating with the protrusion 39 according to this embodiment is advantageously not visible in a closed position of the lid 40, as are, by way of comparison in the second embodiment, the lugs 147 and 247 present on the outer face 41, in the vicinity of the gripping means 45.

The invention claimed is:

1. A packaging device for a cosmetic product, especially for a solid or pasty cosmetic product, the device comprising a base and, an intermediate part intended to carry the product and a lid, the intermediate part being secured to the base and the lid being hingedly mounted on the intermediate part so that said lid occupies two positions, a first closed position of the device where the base and the lid together define a substantially closed space, and a second opened position of the device where the lid is retracted inside the base, wherein said lid is configured to be blocked in the opened position reciprocally and in the closed position by blocking means comprising at least one protrusion of matter protruding from the intermediate part;

wherein the intermediate part comprises two concentric rims, respectively an outer rim and an inner rim, said at least one protrusion of matter protruding from an inner face of the outer rim.

2. The packaging device according to claim 1, wherein said at least one protrusion of matter is circumferentially nearly continuous.

3. The packaging device according to claim 1, wherein the outer rim and the inner rim of the intermediate part are connected to one another by at least hinging means formed by two trunnions that define an axis of rotation for the lid.

4. The packaging device according to claim 1, wherein the outer rim and the inner rim of the intermediate part delimit together an opening configured to enable the passage of the lid.

5. The packaging device according to claim 1, wherein the outer rim of the intermediate part comprises at least a protrusion of matter intended to cooperate with at least a first lug of the lid to block said lid in an opened position.

6. The packaging device according to claim 1, wherein the outer rim of the intermediate part comprises at least a protrusion of matter intended to cooperate with at least a second lug of the lid to block said lid in a closed position.

7. The packaging device according to claim 1, wherein the lid comprises a gripping means designed to enable the handling of the lid so as to move it from its opened position to its closed position and inversely, said gripping means forming a stop to immobilise the motion of the lid in a closed position as well as in an opened position.

8. The packaging device according to claim 7, wherein a first lug and a second lug of the lid are arranged on either side of the gripping means.

9. The packaging device according to claim 1, wherein the intermediate part comprises retaining means, intended to be engaged with the cosmetic product, which extend radially inside the intermediate part and delimiting together at least one opening to enable the casting of said cosmetic product.

* * * * *